US005509975A

United States Patent [19]

Kojima et al.

[11] Patent Number: 5,509,975

[45] Date of Patent: Apr. 23, 1996

[54] SOFT MAGNETIC BULKY ALLOY AND METHOD OF MANUFACTURING THE SAME

[75] Inventors: Akinori Kojima, Sendai; Katsuaki Hangai, Nagaoka; Shoji Yoshida, Nakanoshima; Akihiro Makino, Nagaoka; Tsuyoshi Masumoto; Akihsia Inoue, both of Sendai, all of Japan

[73] Assignees: Alps Electric Co., Ltd.; Tsuyoshi Masumoto; Akihisa Inoue, Tokyo, Japan

[21] Appl. No.: 312,847

[22] Filed: Sep. 27, 1994

Related U.S. Application Data

[62] Division of Ser. No. 212,638, Mar. 14, 1994, abandoned.

[30] Foreign Application Priority Data

| | | | |
|---|---|---|---|
| Mar. 15, 1993 | [JP] | Japan | 5-54224 |
| Sep. 30, 1993 | [JP] | Japan | 5-245709 |
| Feb. 3, 1994 | [JP] | Japan | 6-11980 |

[51] Int. Cl.[6] ..... H01F 1/12

[52] U.S. Cl. ..... 148/104; 419/12; 419/67

[58] Field of Search ..... 148/104; 419/12, 419/67

[56] References Cited

U.S. PATENT DOCUMENTS

| | | | |
|---|---|---|---|
| 4,101,348 | 7/1978 | Berchtold | 148/105 |
| 4,197,146 | 4/1980 | Frischmann | 148/104 |
| 4,985,089 | 1/1991 | Yoshizawa et al. | 148/303 |
| 5,019,190 | 5/1991 | Sawa et al. | 148/306 |
| 5,178,689 | 1/1993 | Okamura et al. | 148/306 |
| 5,192,375 | 3/1993 | Sawa et al. | 148/306 |
| 5,252,148 | 10/1993 | Shigeta et al. | 148/307 |

FOREIGN PATENT DOCUMENTS

| | | |
|---|---|---|
| 0271657 | 6/1988 | European Pat. Off. . |
| 63-304603 | 12/1988 | Japan . |

OTHER PUBLICATIONS

Suzuki, K. et al., "High Saturation Magnetization and Soft Magnetic Properties of bcc Fe–Zr–B and Fe–Zr–B–M (M=Transition Metal) Alloys with Nanoscale Grain Size", vol. 32, No. 1, *Materials Transactions JIM* (1991, pp. 93–102).

*Primary Examiner*—John Sheehan

*Attorney, Agent, or Firm*—Guy W. Shoup; Patrick T. Bever

[57] ABSTRACT

A soft magnetic bulky alloy according to the present invention is obtained by forming under pressure a powder and granule material mainly made of a Fe-M-B based amorphous alloy containing Fe, B and M where M is at least one element selected from a group consisting of Ti, Zr, Hf, V, Nb, Ta, Mo and W. In the soft magnetic bulky alloy, an amorphous alloy phase and a bcc phase with fine grain sizes of 30 nm or below are present in a mixed state, or the bcc phase with fine grain sizes of 30 nm or below is mainly present. The present invention also discloses a method of manufacturing such a soft magnetic bulky alloy.

22 Claims, 20 Drawing Sheets

$Fe_{90}Zr_7B_3$ Te=425°C Pe=923MPa
BULKY ALLOY

SOFT MAGNETIC BULKY ALLOY AND METHOD OF MANUFACTURING THE SAME

This application is a division of application Ser. No. 08/212,638, filed Mar. 14, 1994, abandoned.

BACKGROUND OF THE INVENTION

The present invention relates to a soft magnetic bulky alloy for use as a core of a magnetic head or a magnetic core of a pulse motor, and a method of manufacturing such a soft magnetic bulky alloy.

Generally, the characteristics required for the soft magnetic alloy for use as a core of a magnetic head, a magnetic core of a pulse motor, a transformer or a choke coil are high saturation magnetization, high magnetic permeability, low coercive force, and malleability for shaping into a thin form. In view of the above, various alloys have been studied in the course of developing such alloys.

Conventional materials for use in the above applications are crystalline alloys, such as Sendust, Permalloy or silicon steel. In recent years, Fe or Co based amorphous alloys have also been used.

Regarding magnetic heads, there has been a demand for magnetic materials for higher performance magnetic heads which can cope with magnetic recording media having a high coercive force resulting from an increase in the recording density.

For pulse motors, transformers or choke coils, there has been a demand for materials exhibiting excellent magnetic characteristics which can cope with a reduction in the size and an increase in the frequency.

However, Sendust suffers from a disadvantage in that the saturation magnetization thereof is as low as about 11 kG, although it exhibits excellent soft magnetic characteristics. Permalloy, which has an alloy composition exhibiting excellent soft magnetic characteristics, also has a saturation magnetization as low as about 8 kG. Fe-Si alloys have inferior soft magnetic characteristics, although they have a high saturation magnetization.

Co-based amorphous alloys have an insufficient saturation magnetization, which is about 10 kG, although they exhibit excellent soft magnetic characteristics. Fe-based amorphous alloys tend to exhibit insufficient soft magnetic characteristics, although they have a high saturation magnetization, which is 15 kG or above. Further, amorphous alloys are insufficient in terms of the heat stability and this deficiency must be overcome. Thus, conventionally it is difficult to provide a material exhibiting both high saturation magnetization and excellent soft magnetic characteristics.

In view of the above, the present inventors have noted the soft magnetic alloy described in Material Transactions, JIM Vol. 32 No. 1, January 1991. This alloy has an Fe-M-B based fine grain phase containing Fe, B and M where M is at least one element selected from a group consisting of Ti, Zr, Hf, V, Nb, Ta, Mo and W. This type of alloy exhibits excellent soft magnetic characteristics and a high saturation magnetization. However, since the alloy is generally manufactured in the form of a ribbon, it is difficult to apply to the core of the magnetic head, to the magnetic core of a pulse motor or to the core of a transformer due to the difficulty in machining of the ribbon.

SUMMARY OF THE INVENTION

In consideration of the application of the soft magnetic alloy described in the patent application filed previously by the present inventors to the core of a magnetic head, to the magnetic core of a pulse motor or to the core of a transformer, the present inventors performed formation under pressure of a powder and granule material obtained by milling the soft magnetic alloy having the above composition in order to obtain a desired shape, and thereby concluded the present invention.

In view of the above, an object of the present invention is to provide a soft magnetic bulky alloy which exhibits both excellent soft magnetic characteristics and high saturation magnetization, and-a method of manufacturing such a soft magnetic bulky alloy.

To achieve the above object, the present invention provides a soft magnetic bulky alloy which is-obtained by forming under pressure a powder and granule material mainly made of an Fe-M-B based amorphous alloy containing Fe, B and M where M is at least one element selected from a group consisting of Ti, Zr, Hf, V, Nb, Ta, Mo and W, and which is heat treated (=annealed) so that a crystalline phase thereof obtained after heat treatment can be a mixture of an amorphous alloy phase and a bcc phase with fine grain sizes of 30 nm or below. The crystalline phase obtained after heat treatment may mainly be a bcc phase with fine grain sizes of 30 nm or below.

The present invention further provides a soft magnetic bulky alloy which is obtained by warm extruding a powder and granule material mainly made of an Fe-M-B based amorphous alloy containing Fe, B and M where M is at least one element selected from a group consisting of Ti, Zr, Hf, V, Nb, Ta, Mo and W to form a primarily formed material and by heat treating the primarily formed material so that at least part of the amorphous alloy phase can be modified into a bcc phase with fine grain sizes of 30 nm or below.

In the soft magnetic bulky alloy according to the present invention, since a powder and granule material mainly made of a Fe-M-B based amorphous alloy containing Fe, B and M where M is at least one element selected from a group consisting of Ti, Zr, Hf, V, Nb, Ta, Mo and W is formed under pressure in order to precipitate a bcc phase with fine grain sizes of 30 nm or below, both excellent soft magnetic characteristics and excellent saturation magnetization can be obtained. Further, since such a phase is heat treated in order to further precipitate the fine grains, the soft magnetic characteristics of the obtained alloy can be greatly improved, and the saturation magnetization thereof can be sufficiently increased.

Further, since formation under pressure is performed in an amorphous phase, the fine grains obtained after heat treatment can be made uniform. Thus, a soft magnetic bulky alloy exhibiting both excellent soft magnetic characteristics and excellent saturation magnetization can be obtained. Further, when the element M is Zr and/or Hf, the crystallization temperature can be increased, and formation of an amorphous phase under pressure can thus be made possible.

Further, in the method according to the present invention, since the powder and granule material mainly made of a Fe-M-B based amorphous alloy is warm extruded to form a primary formed material, bulking can be done reliably. Further, since such a primary formed article is heat treated, the bcc phase with fine grain sizes can be precipitated much, thus further improving soft magnetic characteristics and saturation magnetization.

Further, when extrusion is conducted at a temperature near the softening temperature of the Fe-M-B type amorphous alloy utilizing the softening temperature thereof, smooth extrusion can be performed.

Sufficiently effective and reliable extrusion can be performed when the extruding pressure is between 500 and 1300 MPa and the extruding temperature is between 300° and 600° C.

When the extrusion pressure is between 900 and 1300 MPa, a formed material having a high relative density can be obtained. When the extrusion pressure is between 500 and 900 MPa, the soft magnetic characteristics of the formed material can be further improved.

Further, when the heat treatment is conducted at a temperature ranging from 400° to 700° C. after extrusion, an increase in the bcc phase grain size can be prevented, and a fine grain phase can thus be obtained reliably.

In the manufacturing method according to the present invention, when the amorphous alloy ribbon obtained from molten metal of Fe-M-B based alloy is milled ground, since fine powder having a grain size of 53 μm or below is removed, the crystalline phase which has been crystallized from the amorphous phase during milling or the impurities which have entered during milling can be removed from the powder. Thus, only the amorphous powder can be extruded, and the obtained bulky alloy exhibits excellent soft magnetic characteristics and high saturation magnetization.

When the amorphous alloy ribbon obtained from molten metal of Fe-M-B based alloy is milled, since the powder having grain size ranging from 53 to 100 μm is selectively used, the obtained bulky alloy exhibits-excellent soft magnetic characteristics and high saturation magnetization.

DETAILED DESCRIPTION OF THE INVENTION

Figure 1:
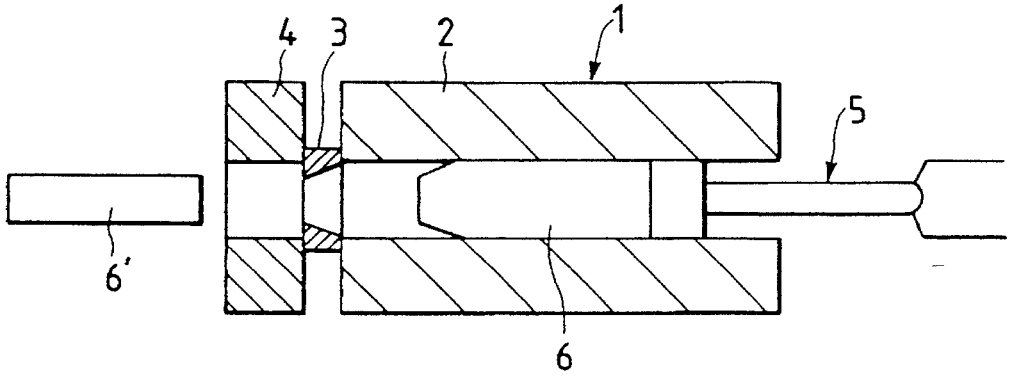
FIG. 1 is a cross-sectional view showing an example of an extruding machine used in the method according to the present invention.

The present invention will now be described in detail.

A soft magnetic bulky alloy manufacturing method according to the present invention comprises the steps of preparing a Fe-M-B based amorphous alloy or crystalline alloy containing an amorphous phase having a predetermined composition, which Will be described later, in the form of a ribbon or powder by quenching molten metal, milling the ribbon and bulking the powder alloy or bulking the alloy powder by extrusion, which will be described later, to obtain a primary formed article, and heat treating the obtained primary formed article.

The amorphous alloy is obtained from the molten metal by quenching in which the molten metal is sprayed onto a rotary drum or by the atomizing process in which the molten metal is injected into a cooling gas to obtain powder.

Composition examples of the amorphous alloy or the crystalline alloy containing the amorphous phase and the reasons therefor will be described below.

COMPOSITION EXAMPLE 1

An alloy having a composition expressed by $(Fe_{1-a}\ Z_a)_b\ B_x\ M_y$, where Z is Co and/or Ni, M is at least one element selected from a group consisting of Ti, Zr, Hf, V, Nb, Ta, Mo and W and contains Zr and/or Hf, a $\leqq 0.05$, $b \leqq 93$ atomic percent, $0.5 \leqq x \leqq 8$ atomic percent, and $4 \leqq y \leqq 9$ atomic percent.

COMPOSITION EXAMPLE 2

An alloy having a composition expressed by $Fe_b\ B_x\ M_y$, where M is at least one element selected from a group consisting of Ti, Zr, Hf, V, Nb, Ta, Mo and W and contains Zr and/or Hf, $b \leqq 93$ atomic percent, $0.5 \leqq x \leqq 8$ atomic percent, and $4 \leqq y \leqq$ atomic percent.

COMPOSITION EXAMPLE 3

An alloy having a composition expressed by $(Fe_{1-a}CO_a)_b B_x M_y L_z$, where M is at least one element selected from a group consisting of Ti, Zr, Hf, V, Nb, Ta, Mo and W and contains Zr and/or Hf, L is at least one element selected from a group consisting of Cu, Ag, Au, Ni, Pd and Pt, $a \leqq 0.05$, $b \leqq 92$ atomic percent, $0.5 \leqq x \leqq 16$ atomic percent, $4 \leqq y \leqq 10$ atomic percent, and $z \leqq 4.5$ atomic percent.

COMPOSITION EXAMPLE 4

An alloy having a composition expressed by $Fe_b B_x M_y L_z$, where M is at least one element selected from a group consisting of Ti, Zr, Hf, V, Nb, Ta, Mo and W and contains Zr and/or Hf, L is at least one element selected from a group consisting of Cu, Ag, Au, Ni, Pd and Pt, $b \leqq 92$ atomic percent, $0.5 \leqq x \leqq 16$ atomic percent, $4 \leqq y \leqq 10$ atomic percent, and $z \leqq 4.5$ atomic percent.

COMPOSITION EXAMPLE 5

An alloy having a composition expressed by $(Fe_{1-a}CO_a)_b B_x M'_y L_z$, where M' is at least one element selected from a group consisting of Ti, Nb and Ta, L is at least one element selected from a group consisting of Cu, Ag, Au, Ni, Pd and Pt, $a \leqq 0.05$, $b \leqq 92$ atomic percent, $6.5 \leqq x \leqq 18$ atomic percent, $4 \leqq y \leqq 10$ atomic percent, and $z \leqq 4.5$ atomic percent.

COMPOSITION EXAMPLE 6

An alloy having a composition expressed by $Fe_b B_x M'_y L_z$, where M' is at least one element selected from a group consisting of Ti, Nb and Ta, L is at least one element selected from a group consisting of Cu, Ag, Au, Ni, Pd and Pt, $b \leqq 92$ atomic percent, $6.5 \leqq x \leqq 18$ atomic percent, $4 \leqq y \leqq 10$ atomic percent, and $z \leqq 4.5$ atomic percent.

COMPOSITION EXAMPLE 7

An alloy having a composition expressed by $(Fe_{1-a}CO_a)_b B_x M'_y L_z Q_s X_t$, where M' is at least one element selected from a group consisting of Ti, Nb and Ta, L is at least one element selected from a group consisting of Cu, Ag, Au, Ni, Pd and Pt, Q is at least either of Zr and Hf, X is an element selected from a group consisting of Cr, Mo, W, Ru, Rh and Ir, $a \leqq 0.05$, $b \leqq 92$ atomic percent $6.5 \leqq x \leqq 18$ atomic percent, $4 \leqq y \leqq 10$ atomic percent, $z \leqq 4.5$ atomic percent, $4 \leqq s \leqq 10$ atomic percent, and $t \leqq 5$ atomic percent.

COMPOSITION EXAMPLE 8

An alloy having a composition expressed by $Fe_b B_x M'_y L_z Q_s X_t$, where M' is at least one element selected from a group consisting of Ti, Nb and Ta, L is at least one element selected from a group consisting of Cu, Ag, Au, Ni, Pd and Pt, Q is at least either of Zr and Hf, X is an element selected from a group consisting of Cr, Mo, W, Ru, Rh and Ir, $b \leqq 92$ atomic percent $6.5 \leqq x \leqq 18$ atomic percent, $4 \leqq y \leqq 10$ atomic percent, $z \leqq 4.5$ atomic percent, $4 \leqq s \leqq 10$ atomic percent, and $t \leqq 5$ atomic percents.

COMPOSITION EXAMPLE 9

An alloy having a composition expressed by $(Fe_{1-a}R_a)_b B_x M'_y$, where R is Co and/or Ni, M' is at least one element selected from a group consisting of Ti, Nb and Ta, $a \leqq 0.05$, $b \leqq 93$ atomic percent, $6.5 \leqq x \leqq 10$ atomic percent, and $4 \leqq y \leqq 9$ atomic percent.

COMPOSITION EXAMPLE 10

An alloy having a composition expressed by $Fe_b B_x M'_y$, where M' is at least one element selected from a group consisting of Ti, Nb and Ta, $b \leqq 93$ atomic percent, $6.5 \leqq x \leqq 10$ atomic percent, and $4 \leqq y \leqq 9$ atomic percent.

COMPOSITION EXAMPLE 11

An alloy having a composition expressed by $(Fe_{1-a}R_a)_b B_x M'_y Q_s X_t$, where R is Co and/or Ni, M' is at least one element selected from a group consisting of Ti, Nb and Ta, Q is at least either of Zr and Hf, X is an element selected from a group consisting of Cr, Mo, W, Ru, Rh and Ir, $a \leqq 0.05$, $b \leqq 93$ atomic percent, $6.5 \leqq x \leqq 10$ atomic percent, $4 \leqq y \leqq 9$ atomic percent, $4 \leqq s \leqq 10$ atomic percent, and $t \leqq 5$ atomic percent.

COMPOSITION EXAMPLE 12

An alloy having a composition expressed by $Fe_b B_x M'_y Q_s X_t$, where M' is at least one element selected from a group consisting of Ti, Nb and Ta, Q is at least one of Zr and Hf, X is an element selected from a group consisting of Cr, Mo, W, Ru, Rh and Ir, $b \leqq 93$ atomic percent, $6.5 \leqq x \leqq 10$ atomic percent, $4 \leqq y \leqq 9$ atomic percent, $4 \leqq s \leqq 10$ atomic percent, and $t \leqq 5$ atomic percent. The reasons for limiting to the/above compositions All of the above compositions contain B. The addition of B enhances the amorphous structure forming ability of the soft magnetic alloy, and restricts the generation of a compound which adversely affects the magnetic characteristics during heat treatment. Hence, the addition of B is essential Like B, Al, Si, C or P is generally used as the amorphous structure forming element. Thus, the addition of these elements is also within the scope of this invention.

In order to readily obtain the amorphous phase, either Zr or Hf having a high amorphous structure forming ability must be added to the soft magnetic alloys of Composition Examples 1 through 4. Part of Zr or Hf can be substituted for by any other 4A through 6A group element including Ti, V, Nb, Ta, Mo and W. Cr is not included because its amorphous structure forming ability is inferior to that of the other elements.

In the soft magnetic alloys of Composition Examples 1, 2 and 9 through 12, b, which is the proportion of Fe, Co or Ni, is 93 atomic percent or below, because more than 93 atomic percent prevents an increase in the permeability. In order to obtain a saturation magnetization of 10 kG or above, it is desirable for b to be 75 atomic percent or above.

In the soft magnetic alloys of Composition Examples 3 and 4, the addition of 0.2 to 4.5 atomic percent of Cu, Ni and at least one element selected from the homologous elements thereof is desirable. The addition of 0.2 atomic percent or below of these elements makes the provision of excellent soft magnetic characteristics in the heat treatment process difficult. However, a reduction in the concentration of Cu increases the concentration of Fe, thus increasing the saturation magnetization. Therefore, the proportion of these elements may be 0.2% or below.

Among the above-described elements, the addition of Cu is particularly desirable. Although the reason why the addition of Cu, Ni and so on greatly improves the soft magnetic characteristics is unknown, the measurement of the Crystallization temperature by differential thermal analysis indicated that the crystallization temperature of the alloy to which Cu, Ni and so on are added is slightly lower than the crystallization temperature of the alloy to which no such element is added. The present inventors consider that a reduction in the crystallization temperature occurred because the addition of Cu, Ni and so on made the amorphous phase non-uniform, thus deteriorating the stability of the amorphous phase. When the non-uniform amorphous phase is crystallized, crystal nuclei are simultaneously formed throughout the amorphous phase. As a result, crystal nuclei are non-Uniformly generated, and fine grains are thus obtained.

Cu, which does not readily form a solid solution with Fe, has a tendency of phase separation. Thus, the addition of Cu generates microscopic fluctuation of the composition during heating, and makes the amorphous phase more non-uniform. For the above reasons, Cu can contribute to the generation of fine grains. From the above-described reasons, any element other than Cu, the homologues thereof, Ni, Pd and Pt can also contribute to the generation of fine grains as long as it can reduce the crystallization temperature. Any element which; does not readily form a solid solution with Fe, like CU, also has the same effect.

In the soft magnetic alloys of Composition Examples 3 through 8, b, which is the proportion of Fe and Co, is 92 atomic percent or below, because a high permeability cannot be obtained when b exceeds 92 atomic percent. When b is 75 atomic percent or above, a saturation magnetization of 10 kG or above can be obtained.

In the soft magnetic alloys of Composition Examples 5 through 12, B and at least one element selected from a group consisting of Ti, Nb and Ta must be added in order to readily obtain an amorphous phase.

Among Ti, Nb and Ta having the similar effect, Nb and Ta are thermally stable metallic materials having a high melting point and cannot be readily oxidized during manufacture. Thus, if the added element ms any of these elements, the manufacturing conditions are easy and the production cost is low. In a practical operation, the manufacture in air or in an inert gas at atmospheric pressure, which is conducted while the inert gas is partially supplied to the distal end portion of the nozzle of a crucible used to quench the molten metal, is enabled.

However, these elements have deteriorated amorphous structure forming ability when compared with B. Thus, in the soft magnetic alloys of Composition Examples 5 through 8, the proportion of B is increased to 6.5 to 18%.

In the soft magnetic alloys of Composition Examples 5 through 8, the addition of 0.2 to 4.5 atomic percent of Cu, Ni and at least one element selected from a group consisting of the homologues thereof is desirable. If the proportion is less than 0.2 atomic percent, the soft magnetic characteristics obtained after heat treatment are slightly degraded but the saturation magnetization is slightly increased. Thus, the proportion of these elements may be 0.2 atomic percent or below. Among these elements, Cu is particularly desirable. Any element other than Cu, the homologues thereof, Ni, Pd and Pt has the same effect as long as it can reduce the crystallization temperature. Any element which does not readily form a solid solution with Fe, like Cu, also has the same effect.

The reasons for limiting the alloy elements contained in the soft magnetic alloy according to the present invention have been described. In addition to the above-mentioned elements, Cr, Mo or a platinum group element, such as Ru, Rh or It, may also be added in order to improve the corrosion resistance. A desirable proportion of such elements is 5 atomic percent or below, because the saturation magnetization is greatly deteriorated if the proportion thereof exceeds 5 atomic percent. When necessary, elements, such as Y, rare earth elements, Zn, Cd, Ga, In, Ge, Sn, Pb, As, Sb, Bi, Se, Te, Li, Be, Mg, Ca, Sr and Ba may also be added in order to adjust the magnetostriction. The composition of the Fe-M-B based soft magnetic alloy according to the present invention remains the same even if unavoidable impurities, such as H, N, O or S, is present in the alloy in an amount which does not deteriorate desired characteristics thereof.

After the material having any of the aforementioned compositions is weighed and mixed, it is melted by vacuum melting or arc melting to form an ingot. The ingot is melted in a crucible and the resulting molten metal is sprayed for quenching from an injection hole formed at the distal end of the crucible onto the surface of a rotating metal roll, such as a rotating copper roll, together with a carrier gas to obtain a ribbon-shaped amorphous alloy.

Next, the obtained amorphous alloy ribbon is milled using a milling machine, such as a rotor speed mill or a planetary ball mill, to obtain a milled material.

The obtained milled material is classified into a material having a grain size of 53 μm or below, a material having a grain size ranging from 53 to 150 μm and a material having a grain size of 150 μm, utilizing a mesh.

The milled material having a grain size of 53 μm or above is employed in the following process. Here, the milled material refers to either powder or granule or a mixture of powder and granule. The use of the milled material having a very small grain size is undesirable, because such a milled material may contain metal materials, such as a stainless steel which forms the blade of a milling machine, That is, since the amorphous alloy having the aforementioned composition is very hard, when it is milled, part of the blade of the milling machine or the part thereof which rubs the amorphous alloy may be separated and enter the milled material.

Removal of the milled material having a small grain size is desirable also because the amorphous portion thereof may be turned into a crystalline phase due to the mechanical function and frictional heat which acts thereon during milling.

The above-described classification is performed in order to remove the impurities which are considered to enter into the material when the ribbon is milled. Thus, if amorphous alloy powder in which no impurities are present therein can be obtained by, for example, atomization, classification is not necessary.

The prepared milled material is bulked using an extruder. FIG. 1 illustrates an example of the machine used in this extrusion process.

An extruder 1 includes a cylindrical container 2, a die 3 mounted on an outlet of the container 2, and a die press 4 for pressing the die 3. A billet 6 can be pushed into the container 2 by a pressing bar 5, whereby the billet 6 is extruded through the die 3 as an extruded billet 6' in which the milled material accommodated therein has been formed.

In the billet 6, a core 1B is provided in a cylindrical casing 10 having a closed distal end, and a milled material 12 to be bulked can be filled in the casing 10. The rear end portion of the casing 10 is closed by an inner cap 13 and an outer cap 14. The core 11 may not be used. However, the use thereof is desirable from the viewpoint of the provision of an excellent extruded material.

During extrusion conducted using the extruding device 1 shown in FIG. 1, the extrusion temperature is desirably set to a temperature slightly lower than the crystallization temperature of the alloy having the above composition by adjusting the temperature of the container 2. In an actual operation, the extrusion temperature is set to a range from 300° to 600° C. The present inventors conducted studies, and discovered that the softening point at which the Fe-B type amorphous alloy is softened is close to the crystallization temperature. Thus, smooth extrusion of the milled amorphous alloy material can be conducted when extrusion is conducted at a temperature close to that softening point.

Preferable extrusion pressure is from 500 to 1300 MPa.

The present inventors conducted experiments in the manner described later and found that the milled material could not be formed when the extrusion pressure was 495 MPa and that an extrusion pressure of 1300 MPa or above was a burden to the extruding machine.

Bulking of the milled alloy material having the above composition may also be conducted by HIP (Hot Isostatic Pressing). However, since this method requires a treatment at a high temperature of 800° C. or above, the grain size of the fine grains precipitated in the amorphous phase during that high temperature treatment may be increased, thus deteriorating the magnetic characteristics. Thus, extrusion is preferred as the bulking means.

After extrusion, a bulky alloy is removed from the billet 6, and the removed bulky alloy is subjected to heat treatment. In a bulky alloy which has just been extruded, bcc phase with fine grain size is partially present in the major amorphous phase.

The bulky alloy which has just been extruded is insufficient for use in magnetic heads in terms of the magnetic characteristics. It is therefore subjected to heat treatment in order to precipitate fine grains and thereby improve the magnetic characteristics.

The heat treatment is conducted at a temperature higher than the crystallization temperature of-the amorphous alloy, e.g., ranging from 550° to 650° C. In this way, the mixed phase structure can be changed into a crystalline phase structure having the bcc phase with fine grain size of about 30 nm or below, and the magnetic characteristics can thus be improved.

This heat treatment increases a saturation magnetization (Bs, σs) of the bulky alloy and reduces the coercive force (Hc) thereof.

The bulky alloy manufactured in the manner described above has an excellent saturation magnetization, a high magnetic permeability and a low coercive force. Thus, the manufactured bulky alloy can be applied to various magnetic parts, such as the core of a magnetic head, the core of a transformer or the magnetic needle of a pulse motor. The manufactured magnetic parts exhibit excellent characteristics as compared with the conventional ones.

EXAMPLES

Materials having the compositions listed in Table 1 were weighed and mixed, and then melted by arc melting to obtain ingots. The ingots were each melted in a crucible, and a plurality of amorphous alloy ribbon samples were obtained by the liquid quenching in which the molten metal was sprayed from the nozzle of the crucible onto a rotary roll. Liquid quenching was conducted under conditions that the argon gas pressure was between 36 and 56 cmHg, that the rotational speed of the copper roll was 2500 to 3000 rpm and that the argon injecting pressure was 0.1 to 1 kg/cm$^2$.

TABLE 1

| | | Material of billet | | | Extruding conditions | | | |
|---|---|---|---|---|---|---|---|---|
| No | Composition | Casing | Core | Phase of powder | Temperature (°C.) | Speed mm/s | Pressure (MPa) | Reduction in cross-sectional area |
| 1 | Fe84Nb7B9 | SS41 | S45C | Amorphous 53 to 150 | 425 | 5 | 862 | 40 |
| 2 | Fe84Nb7B9 | SS41 | S45C | Amorphous 53 to 150 | 450 | 5 | 933 | 40 |
| 3 | Fe84Nb7B9 | SS41 | S45C | Amorphous 53 to 150 | 425 | 5 | 965 | 40 |
| 4 | Fe84Nb7B9 | SS41 | SKD4 | Amorphous 53 to 150 | 400 | 5 | 1074 | 40 |
| 5 | Fe84Nb7B9 | SS41 | SKD4 | Amorphous 53 to 150 | 425 | 5 | 1102 | 40 |
| 6 | Fe84Nb7B9 | SS41 | SKD4 | Amorphous 53 to 150 | 380 | 5 | 1216 | 40 |
| 7 | Fe84Nb7B9 | SS41 | SKD4 | Amorphous 53 to 150 | 425 | 5 | 1208 | 40 |
| 8 | Fe84Nb7B9 | SS41 | SKD4 | Amorphous 53 to 150 | 425 | 5 | 922 | 40 |
| 9 | Fe84Nb7B9 | SS41 | SKD4 | Amorphous 53 to 150 | 400 | 5 | 1162 | 40 |
| 10 | Fe83Nb7B10 | SS41 | SKD4 | Amorphous 53 to 150 | 450 | 5 | 1387 | 40 |
| 11 | Fe82Nb7B11 | SS41 | SKD4 | Amorphous 53 to 150 | 450 | 5 | 1208 | 40 |
| 12 | Fe83Nb8B9 | SS41 | SKD4 | Amorphous 53 to 150 | 450 | 5 | 1603 | 40 |
| 13 | Fe80Nb7B12Cu1 | SS41 | S45C | bcc | 400 | 5 | — | 40 |
| 14 | Fe80Nb7B12Cu1 | SS41 | S45C | bcc | 425 | 5 | — | 40 |

Each of the obtained amorphous alloy ribbon samples was primarily milled with a roller speed mill, and then secondarily milled for 6 hours with a planetary ball mill. Milling was conducted in an Ar atmosphere. The obtained milled material was classified into a material having a grain size of 53 μm, a material having a grain size of 53 to 150 μm, and a material having a grain size of 150 μm.

Figure 3:
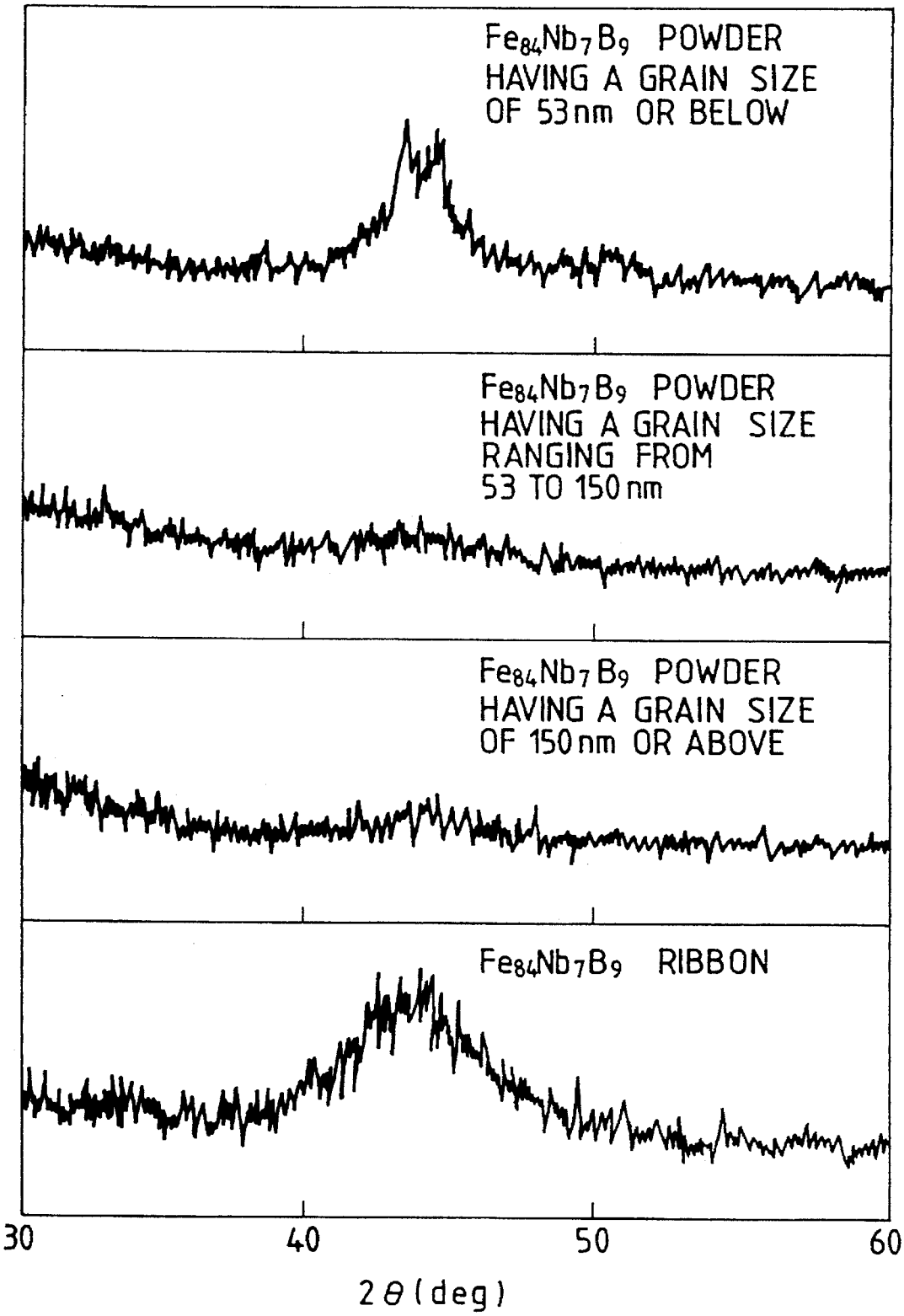
FIG. 3 shows X-ray diffraction patterns of amorphous alloy powder having a composition expressed by $Fe_{84}Nb_7B_9$.

X-ray diffraction test was conducted on both the amorphous alloy ribbon sample having a composition expressed by $Fe_{84}Nb_7B_9$ and on the milled materials of above mentioned grain sizes, obtained from that amorphous alloy ribbon sample. FIG. 3 shows the results of the test.

There was a broad peak in the ribbon sample and the powder samples having the grain size of 53 μm or above, and it was made clear from the results shown in FIG. 3 that these samples were amorphous.

There was a sharp peak showing the bcc or other phase in the sample of the grain size of 53 μm or below. It considered that such a sharp peak was caused by the entrance of, for example, stainless steel powder removed from the metal portions (made of a stainless steel) of a milling machine employed for milling the sample, such as a roller speed mill or a ball mill, during milling. It is also considered that the sharp peak was caused because part of the amorphous alloy powder milled to a grain Size of 53 μm or below was crystallized due to the mechanical friction or heat which acted during milling. Therefore, the powder and granule having the grain size of 53 to 150 μm was employed in the subsequent processes.

In order to facilitate milling, part of the amorphous alloy ribbons was vacuum heated at 500° C. for 1 hour before milling so that the amorphous alloy ribbon heated to a temperature higher than the crystallization temperature could be crystallized. The bcc phase is more brittle than the amorphous phase and this was utilized in order to facilitate milling.

Figure 4:
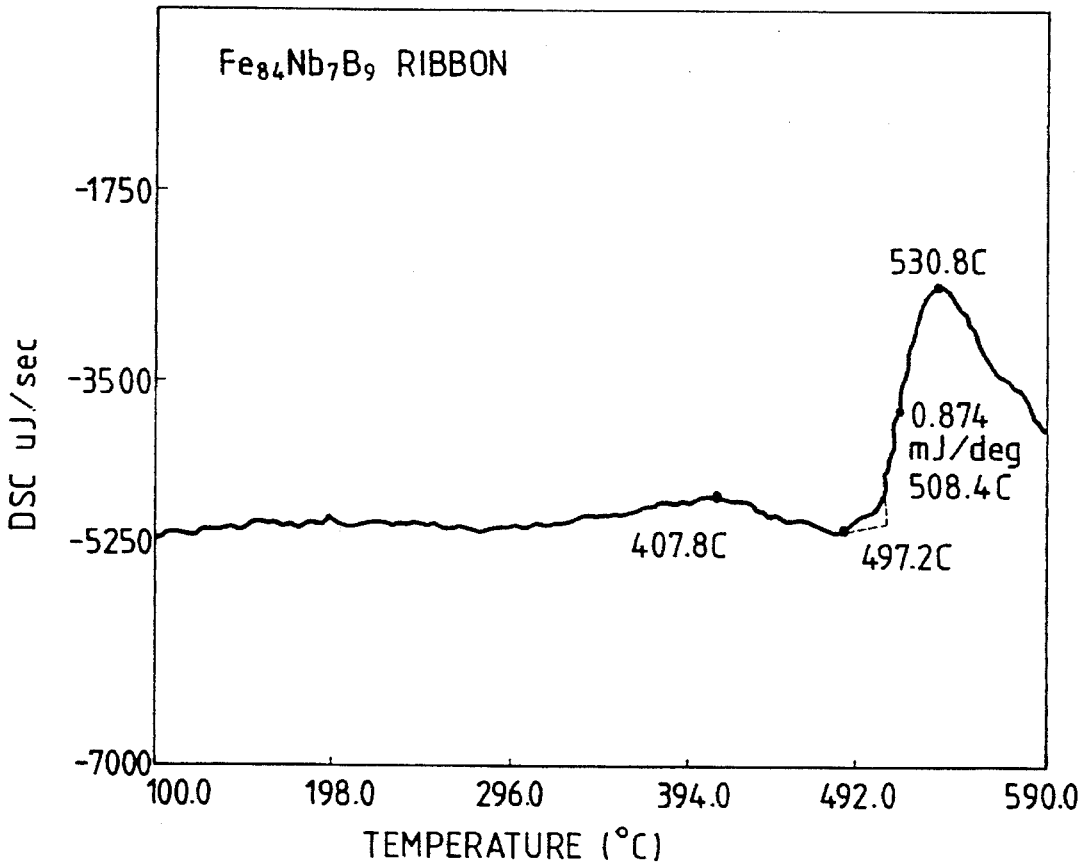
FIG. 4 shows a DSC curve of an amorphous alloy ribbon having a composition expressed by $Fe_{84}Nb_7B_9$.
Figure 5:
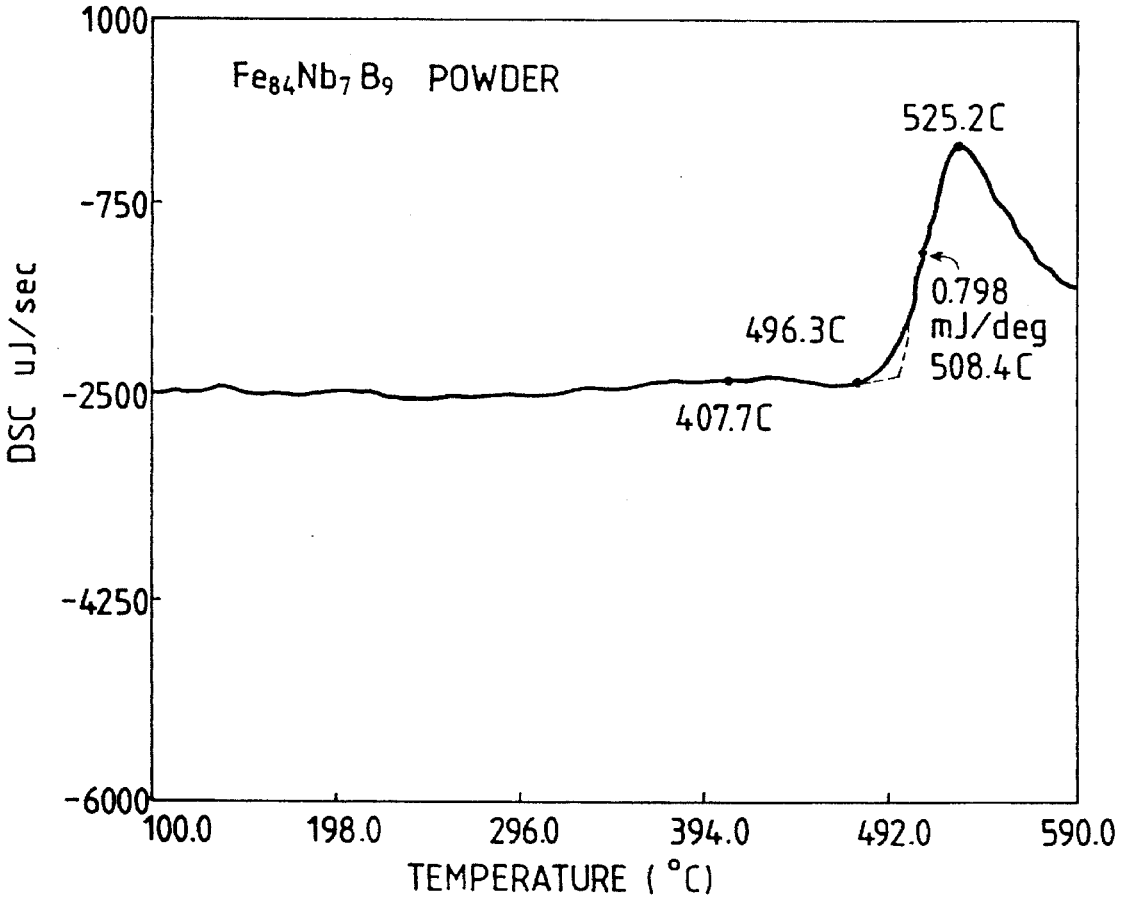
FIG. 5 shows a DSC curve of amorphous alloy powder having a composition expressed by $Fe_{84}Nb_7B_9$.

A DSC (differential scanning caloriemeter) curve (the measured values of differential thermal analysis) of the ribbon sample having a composition expressed by $Fe_{84}Nb_7B_9$ and that of the powder sample were obtained. FIGS. 4 and 5 show such curves.

It can be seen from FIGS. 4 and 5 that the DSC curve of the powder sample and that of the ribbon sample are substantially the same and have a peak which is caused by crystallization. In addition, it was found that the crystallization temperature of the above $Fe_{84}Nb_7B_9$ alloy (the temperature at which bcc phase is generated) was 497° C. This indicates that formation of the alloy having the above composition in an amorphous state must be conducted at a temperature lower than the crystallization temperature of 497° C.

Figure 6:
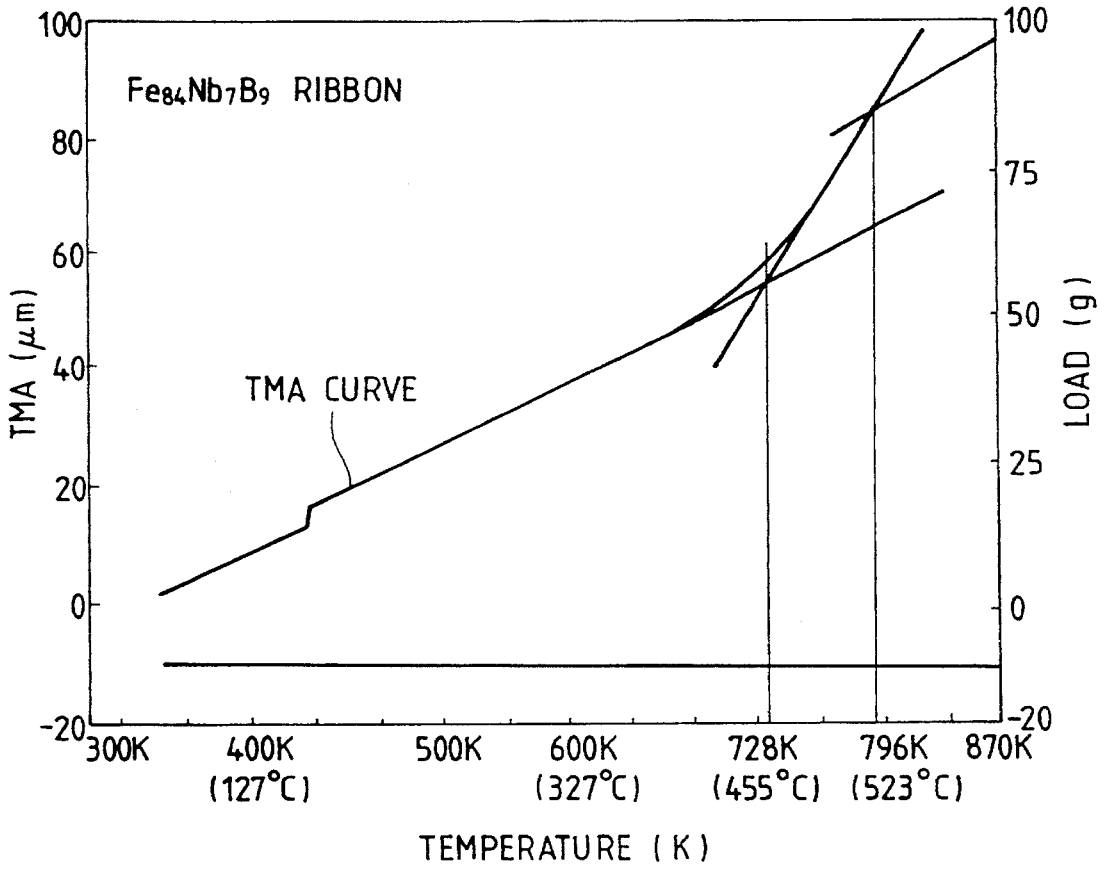
FIG. 6 shows a TMA curve of amorphous alloy powder having a composition expressed by $Fe_{84}Nb_7B_9$.

FIG. 6 shows a TMA (thermo mechanical analysis) curve of the amorphous alloy ribbon sample having the composition expressed by $Fe_{84}Nb_7B_9$.

The TMA curve of the $Fe_{84}Nb_7B_9$ alloy increases rapidly between 455° and 522° C. This indicates that the $Fe_{84}Nb_7B_9$ alloy is softened in that temperature range.

It is clear from both the DSC curves shown in FIGS. 4 and 5 and the TMA curve shown in FIG. 6 that the sample is softened at a temperature where the bcc phase thereof is crystallized, that is, the softening point is close to the crystallization temperature.

It is thus apparent that extrusion can be made effective if it is conducted on the milled material which has been softened at a temperature close to the crystallization temperature.

Figure 2:
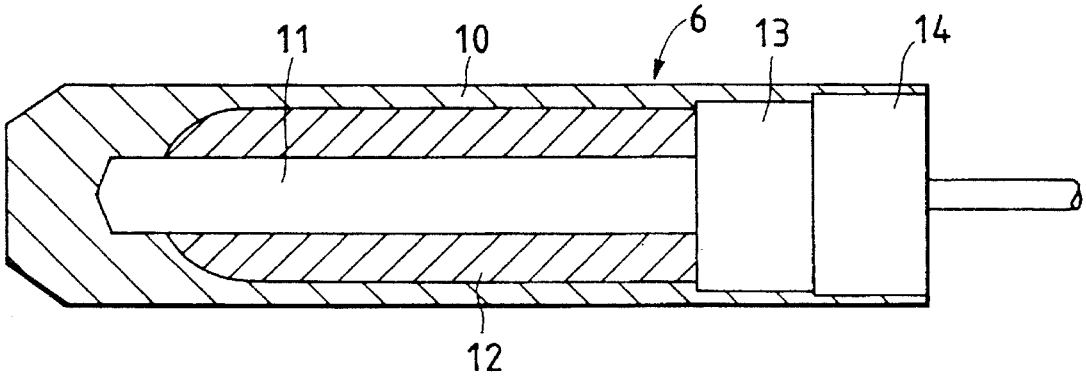
FIG. 2 is a cross-sectional view of a billet used in the extruding machine shown in FIG. 1.

Each of the manufactured samples was bulked using the device shown in FIGS. 1 and 2, At that time, the interior of the billet was evacuated to $1\times10^{-4}$ torr or below, and such a billet was extruded in a 100-ton warm extruder. The temperature, the speed, the pressure and the reduction in cross-sectional area of extrusion are shown in Table 1. The extrusion temperature is the temperature of the container and sample. The extrusion speed is the speed of the pressing bar. The reduction in the cross-sectional area RA is expressed by $$RA = \frac{D_1 - D_2}{D_1} \times 100\ (\%),$$

where $D_1$ is the diameter of the billet which is not yet extruded and $D_2$ is the diameter of the extruded billet.

Regarding the material of the billet, SS41, the material of the casing, represents a hot rolled steel having a composition of no more than 0.05% P, no more than 0.05% S and the balance Fe and conforming to JIS (Japanese Industrial Standard). S45C, the material of the core, represents a carbon steel conforming to JIS and having a composition of 0.42 to 0.48% C, 0.15 to 0.35% Si, 0.6 to 0.9% Mn, 0.030% or below P, 0.035% or below S, and the balance Fe. SKD4, the material of the core, represents a steel conforming to JIS and having a composition of 0.25 to 3.5% C, 0.40% or below Si, 0.60% or below Mn, 0.030% or below P, 0.030% or below S, 2.00 to 3.00% Cr, 5.00 to 6.00% W, 0.30 to 0.50% V and the balance Fe.

Table 2 shows the characteristics of the extruded samples.

TABLE 2

| No. | Composition | Formed state | Annealing temperature (°C.) | Density (g/cm) | Hc (Oe) | σs (emm/g) | Bs (T) |
|---|---|---|---|---|---|---|---|
| 1 | Fe84Nb7B9 | Δ | 650 | 7.15 to 7.40 | 1.8 | 158 | 1.47 |
| 2 | Fe84Nb7B9 | Δ | 650 | | 4.1 | 160 | |
| 3 | Fe84Nb7B9 | ○ | 650 | | 2.2 | 155 | |
| 4 | Fe84Nb7B9 | ○ | 650 | 7.49 to 7.52 | 2.8 | 155 | 1.46 |
| 5 | Fe84Nb7B9 | ◎ | 650 | 7.51 | 2.5 | 157 | 1.48 |
| 6 | Fe84Nb7B9 | ○ | 650 | | 3.6 | 159 | |
| 7 | Fe84Nb7B9 | ○ | 650 | | 4.2 | 154 | |
| 8 | Fe84Nb7B9 | ○ | 650 | | 2.9 | 157 | |
| 9 | Fe84Nb7B9 | ◎ | 650 | 7.55 | 2.8 | 156 | 1.47 |
| 10 | Fe834Nb7B10 | ◎ | 650 | 7.53 | 3.16 | 149 | 1.41 |
| 11 | Fe82Nb7B11 | ◎ | 600 | 7.54 | 2.2 | 141 | 1.34 |
| 12 | Fe83Nb8B9 | ◎ | 650 | | 2.8 | | |
| 13 | Fe80Nb7B12Cu1 | x | 600 | | | | |
| 14 | Fe80Nb8B12Cu1 | x | 650 | | | | |

The obtained bulky alloys were observed with a microscope. In Table 2, ⊙ indicates the excellently bulked samples having substantially no pores. o indicates the sufficiently bulked samples having a slight amount of pores. Δ indicates the samples which were bulked but have pores. x indicates the samples which were hardened but insufficiently bulked.

It is clear from Table 1 and Table 2 that the sample obtained by milling the amorphous alloy ribbon could be bulked and that the sample which was heated before milling to obtain the bcc phase could not be bulked under the same conditions as those of bulking the amorphous phase. Further, the excellent bulked samples were those bulked under a pressure of 900 MPa or above.

Figure 7:
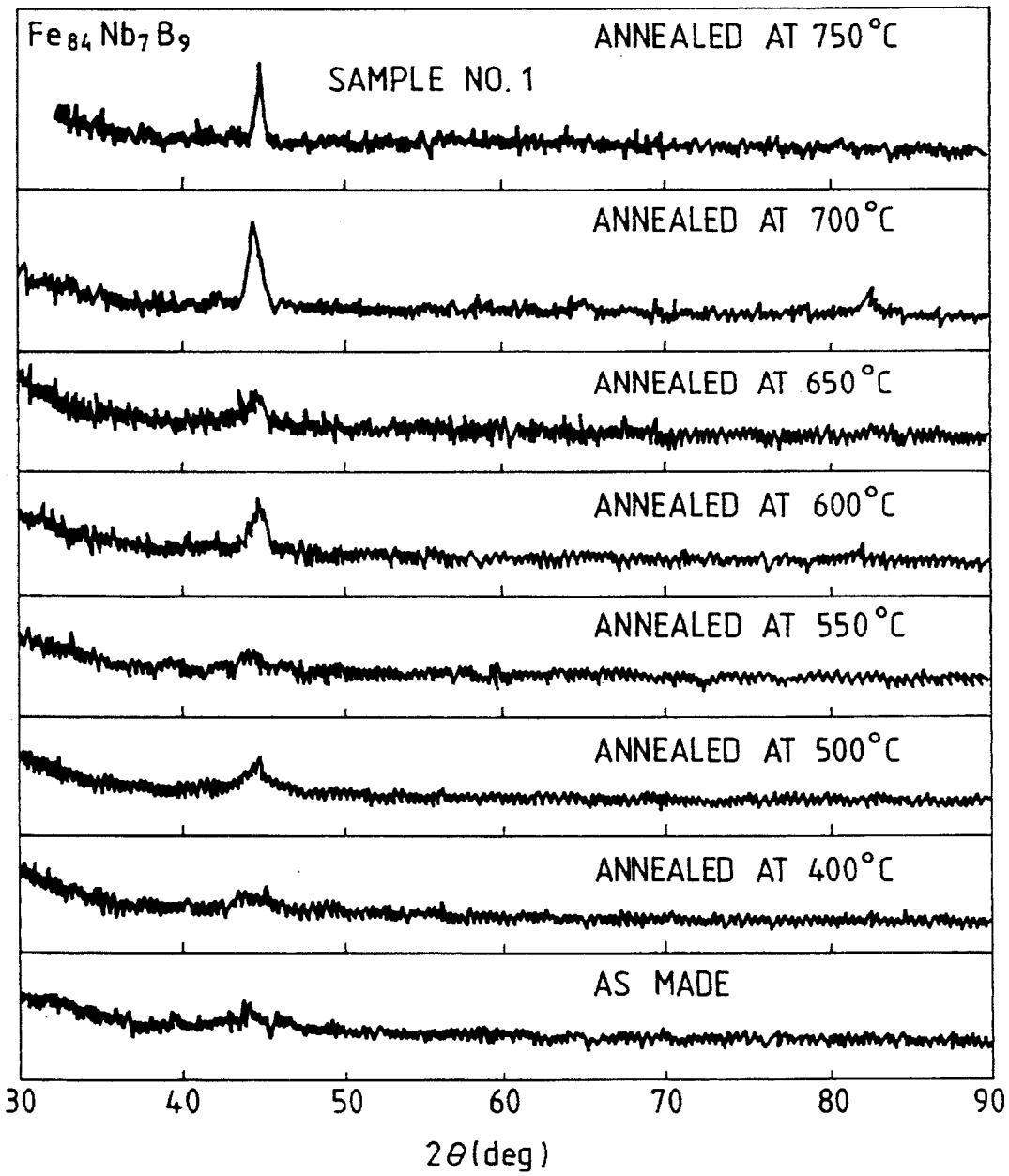
FIG. 7 shows X-ray diffraction patterns of an extruded material having a composition expressed by $Fe_{84}Nb_7B_9$, which were obtained at various heat treating temperatures.
Figure 8:
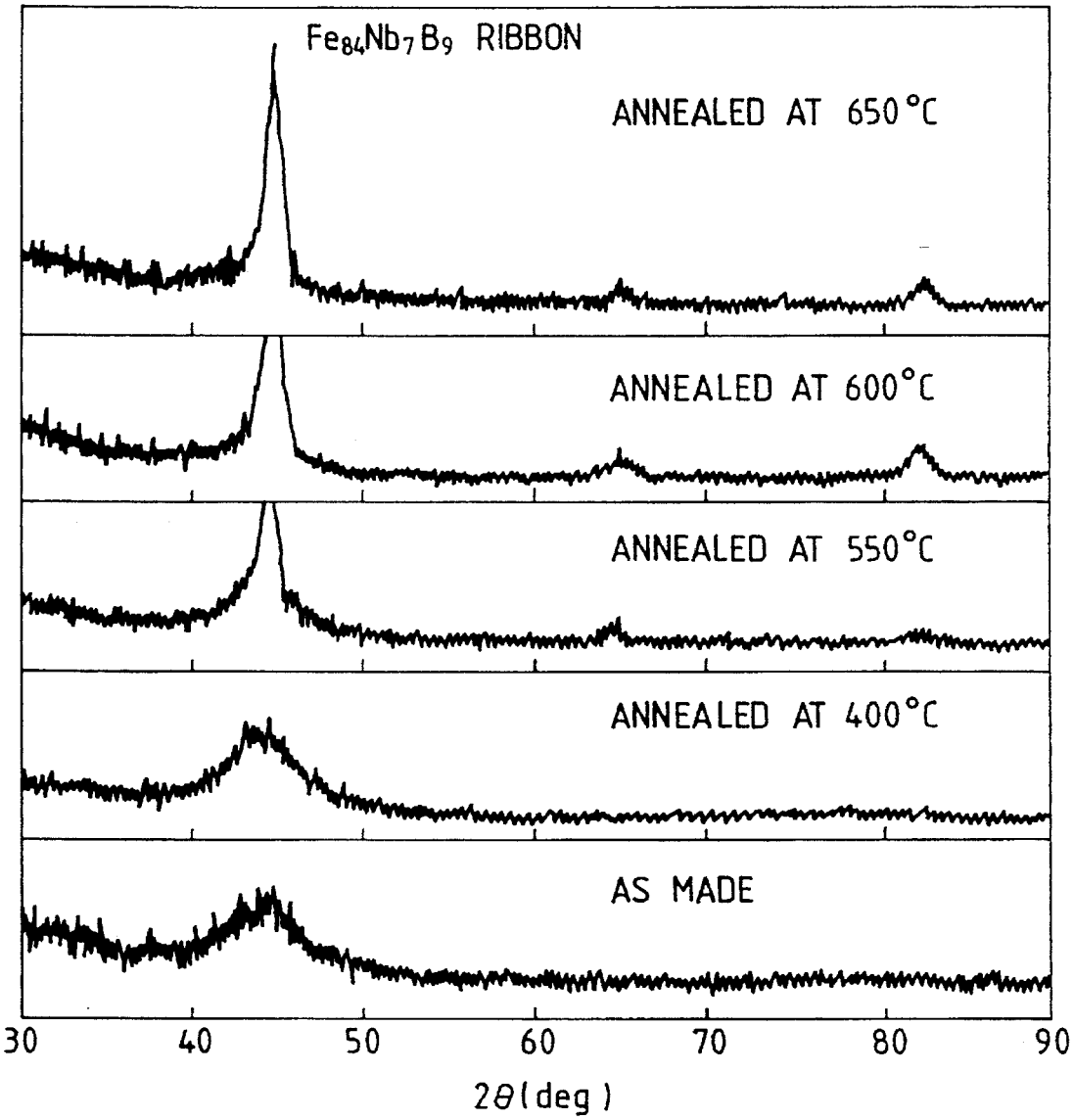
FIG. 8 shows X-ray diffraction patterns of an amorphous alloy ribbon having a composition expressed by $Fe_{84}Nb_7B_9$, which were obtained at various heat treating temperatures.

Table 3 shows the results of the measurements of the magnetic characteristics of the, bulked samples which were heat treated at a temperature ranging from 400° to 750° C. FIG. 7 shows the X-ray diffraction patterns of those samples. For comparison, the X-ray diffraction patterns of the heat treated amorphous alloy ribbon samples are shown in FIG. 8. In Table 3, Hc at a heat treating temperature of 550° C. is a value in a non-saturated state.

TABLE 3

| Composition | Heat treating temperature (°C.) | σs (emu/g) | Bs (T) | Hc (Oe) |
|---|---|---|---|---|
| Fe84Nb7B9 | 550 | 107.3 | 1.0 | (15) |
| Fe84Nb7B9 | 600 | 152.6 | 1.42 | 4.2 |
| Fe84Nb7B9 | 650 | 158.0 | 1.47 | 1.8 |
| Fe84Nb7B9 | 700 | 163.7 | 1.52 | — |

It is clear from Table 3 that a heat treating temperature of 600° C. or above assures bulky alloys exhibiting excellent magnetic characteristics which can be used for high-density recording magnetic heads. It is, however, noted that the samples which were not heat treated after extrusion can also be put into a practical use because Bs and σs thereof are substantially the same as those of the conventional samples.

From the results of the measurements conducted by the present inventors in the aforementioned patent application, the material in which the bcc phase is present in the amorphous alloy has Vickers hardness of 700 to 1400 DPN, and can thus be used as a harder bulky material than the conventional material although it exhibits the same degree of magnetic characteristics as those of the conventional one.

It can be seen from FIG. 7 that the X-ray diffraction patterns have a bcc phase peak when the samples were heat treated at 500° C. or above and that the sample which was heat treated at 750° C. also has the bcc single phase. It can also be seen from FIG. 7 that the samples have a broad peak which is inferred as a phase approximated to the amorphous phase when they were heated at 400° C. or below. However, since extrusion is conducted on these samples at 400° C., which means that the temperature of part of the sample may have been increased to a value close to 500° C. due to the frictional heating during extrusion, it is inferred that the bcc phase is partially present in the sample.

As shown in FIG. 8, the X-ray diffraction pattern of the amorphous alloy ribbon sample which was heat treated at 400° C. or below has a broad peak which indicates the amorphous phase. The X-ray diffraction pattern of the amorphous alloy ribbon sample which was heat treated at 500° C. or above has a peak which indicates the bcc phase. This X-ray diffraction pattern coincides with the DSC curve shown in FIG. 4 which has a bcc phase crystallization peak at 497° C.

Figure 9:
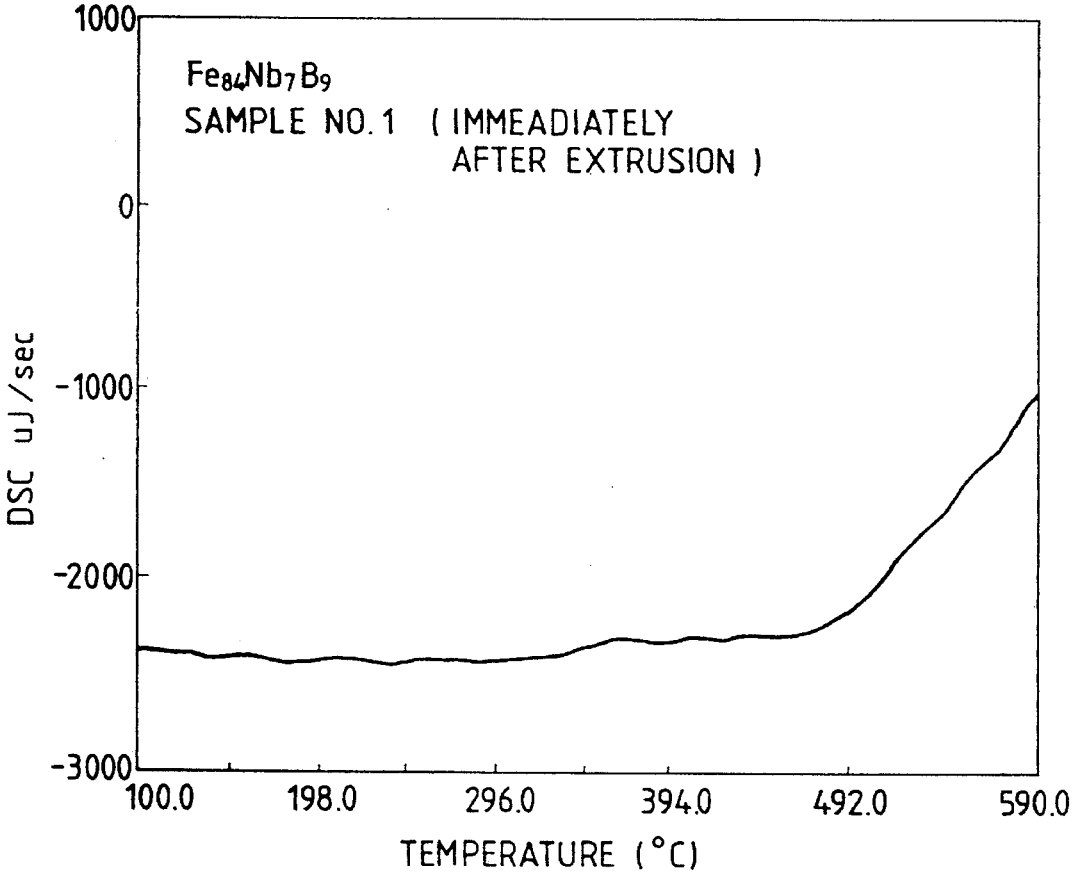
FIG. 9 shows a DSC curve of an extruded material having a composition expressed by $Fe_{84}Nb_7B_9$.

FIG. 9 shows the DSC curve of the just extruded sample. The DSC curve shown in FIG. 9 has a heating peak, which may indicate the precipitation of the bcc phase, at about 490° C. This indicates that this sample has the amorphous phase. However, since the amount of reaction of the heating peak is smaller than that of the powder shown in FIG. 5, it is estimated that a certain amount of bcc phase is already present in the amorphous phase. It is thus apparent from FIG. 9 that the sample which was just extruded has a mixed structure of the amorphous phase and the bcc phase.

Figure 10:
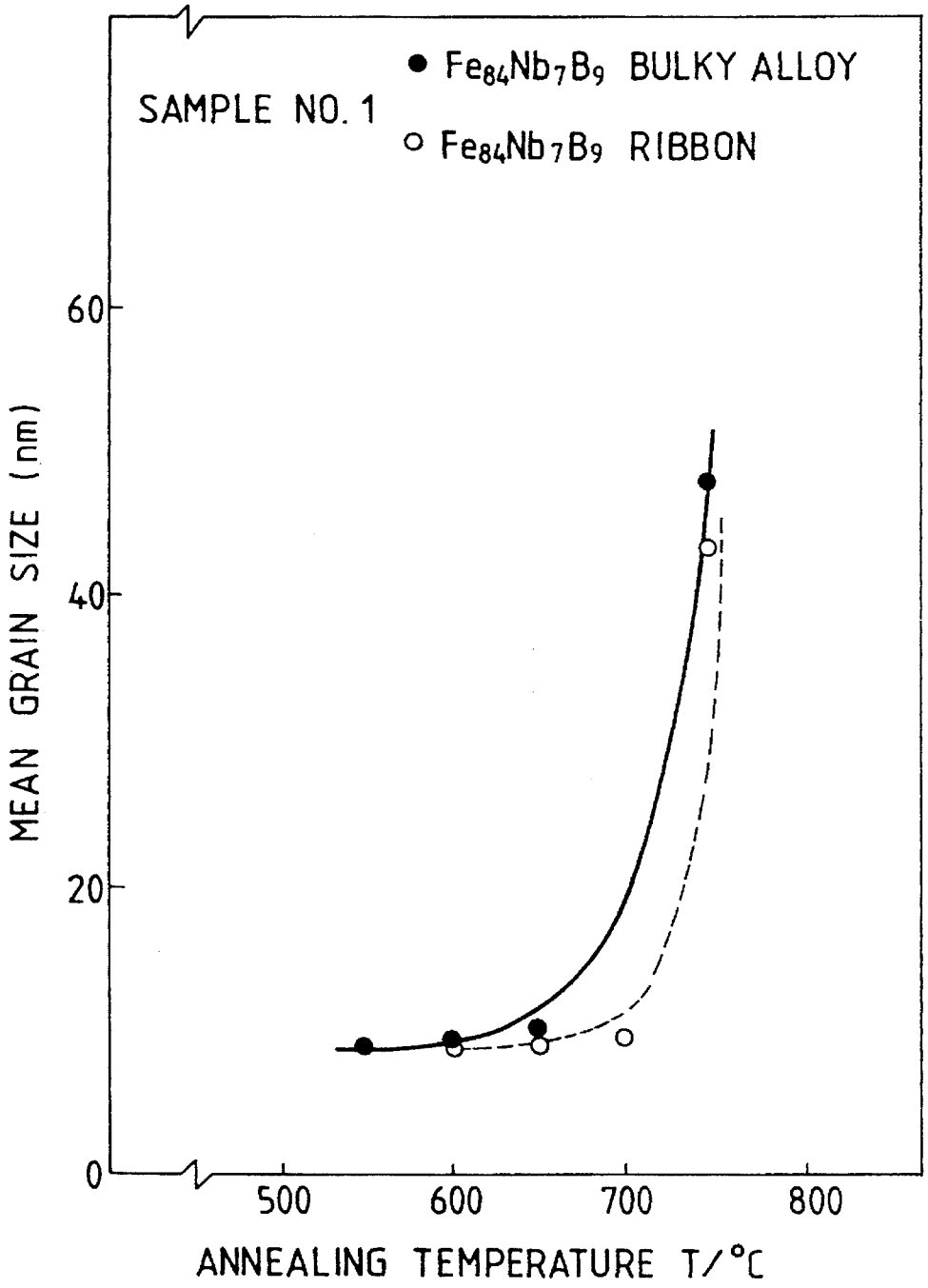
FIG. 10 shows the relation between the heat treating temperature and the grain size.

FIG. 10 shows the heat treatment temperature dependency of the grain size, obtained by the X-ray diffraction pattern bcc (110) peak. When the heat treatment was conducted at 650° C. or 700° C., both the extruded sample and the ribbon sample, both having a composition expressed by $Fe_{84}Nb_7B_9$, had a fine grain size of 10 nm. When the sample was heat treated at 750° C., the bcc grains grew readily in the sample.

Figure 11:
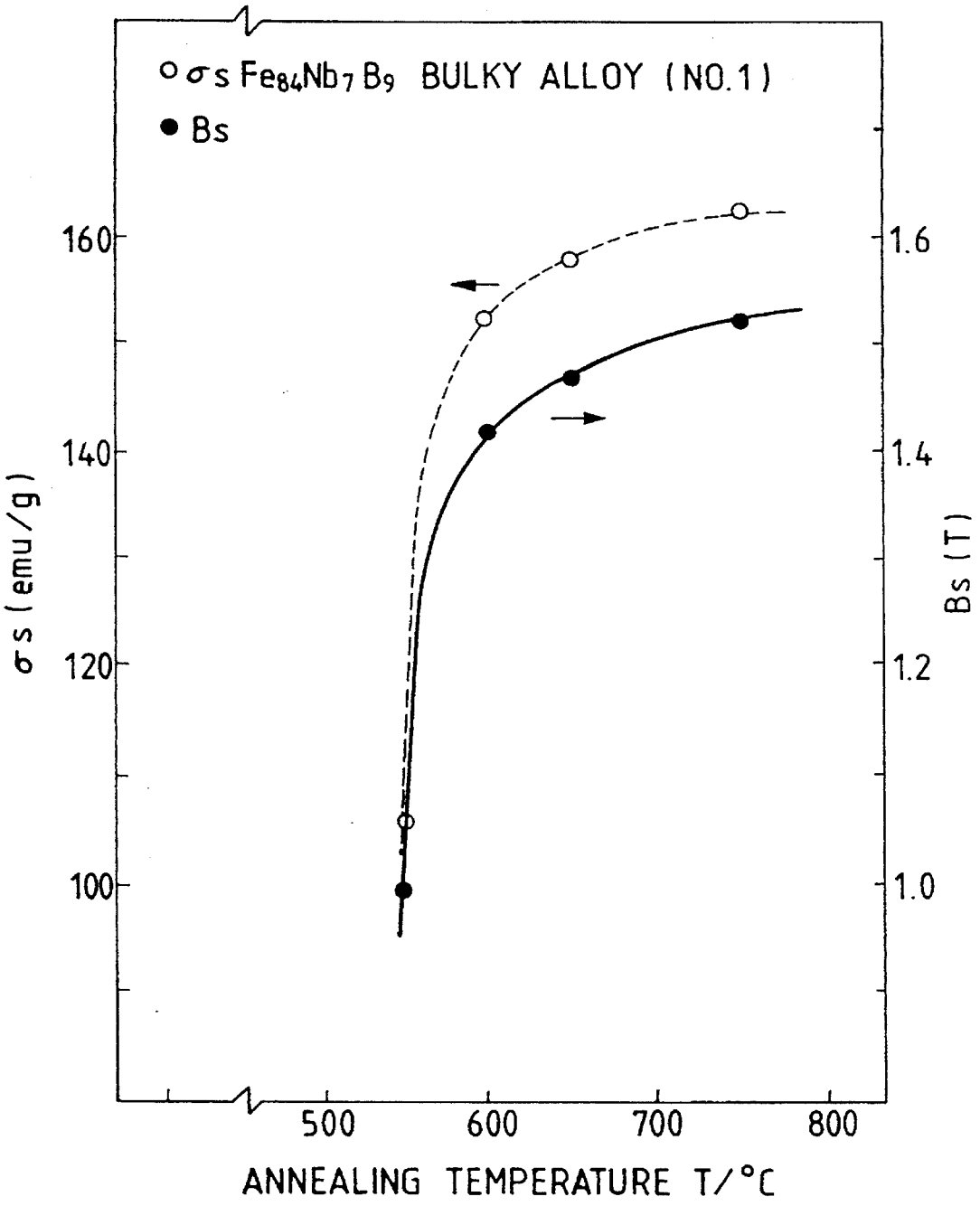
FIG. 11 shows the relation between the heat treating temperature and the saturation magnetization.

FIG. 11 shows the relation, between the heat treating temperature and the magnetic characteristics shown in the heat treated sample. It is clear from FIG. 11 that the heat treated sample has an increased saturation magnetization (Bs) and (σs). It is estimated that this is caused by the crystallization of the bcc phase.

Figure 12:
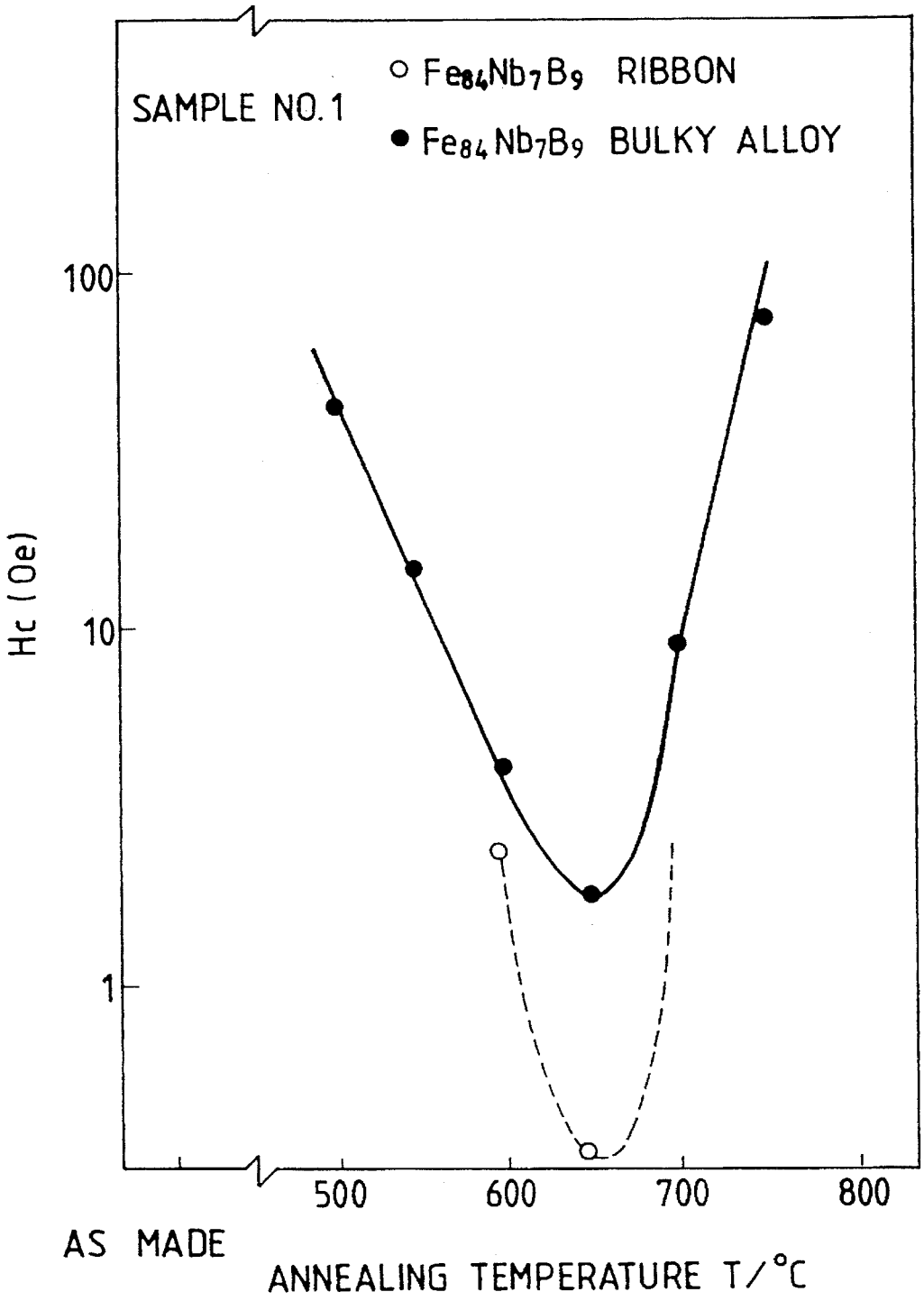
FIG. 12 shows the relation between the heat treating temperature and the coercive force.

FIG. 12 shows the heat treating temperature dependency of the coercive force of both the extruded sample and the amorphous alloy ribbon sample having a composition expressed by $Fe_{84}Nb_7B_9$. It is clear from FIG. 12 that the coercive force has a minimum value when the heating temperature is about 650° C. It is thus clear that the heat treatment at a temperature ranging from 500° to 700° C. is desirable.

Figure 13:
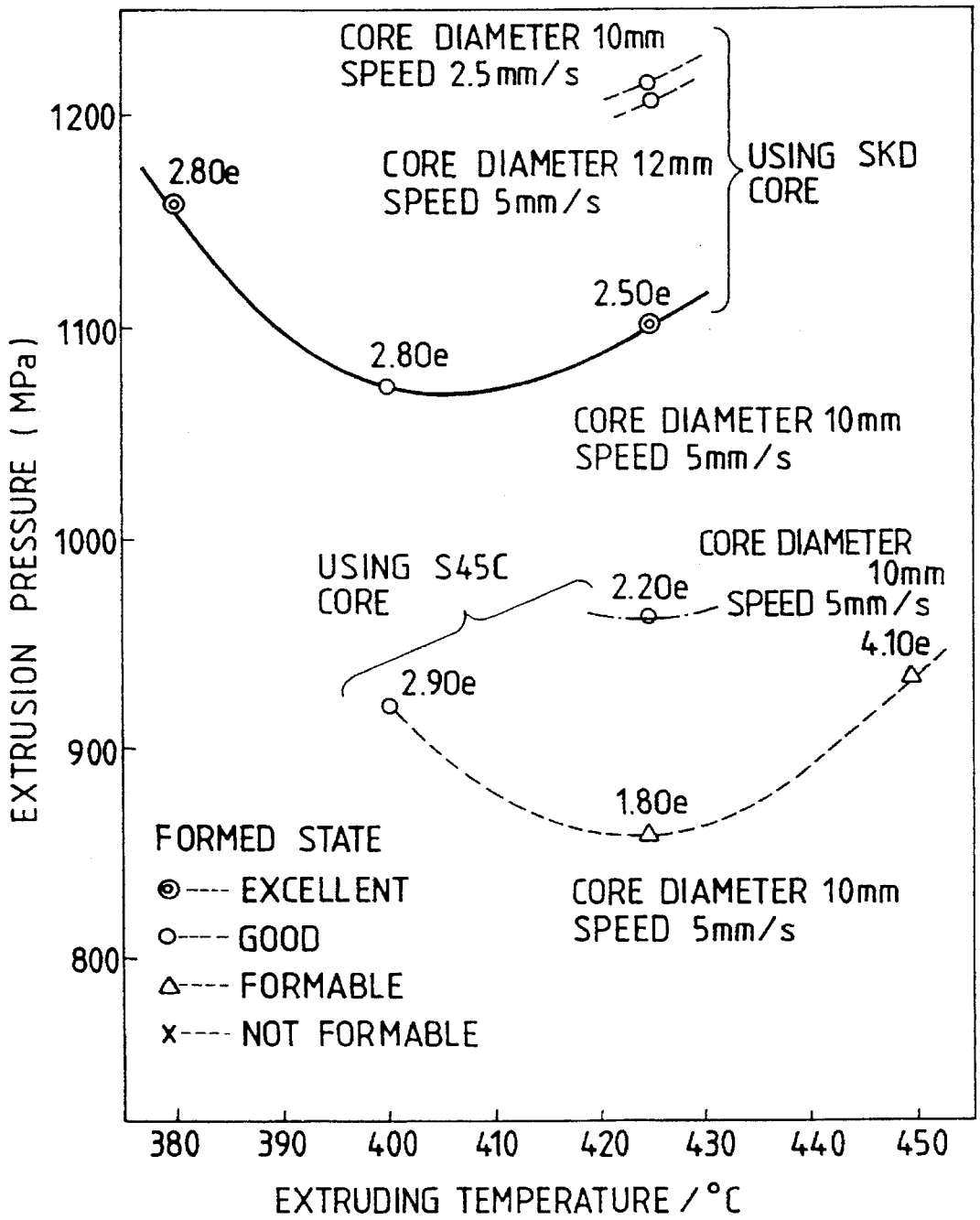
FIG. 13 shows the relation between the extruding temperature and extruding pressure and the coercive force.

FIG. 13 shows the relation between the extrusion conditions and the influence of the extrusion conditions on the formed state of various extruded samples at an optimum temperature (650° C.). It is clear from FIG. 13 that when the extruding pressure is from 900 to 1200 MPa, an excellently formed material can be obtained.

Figure 14:
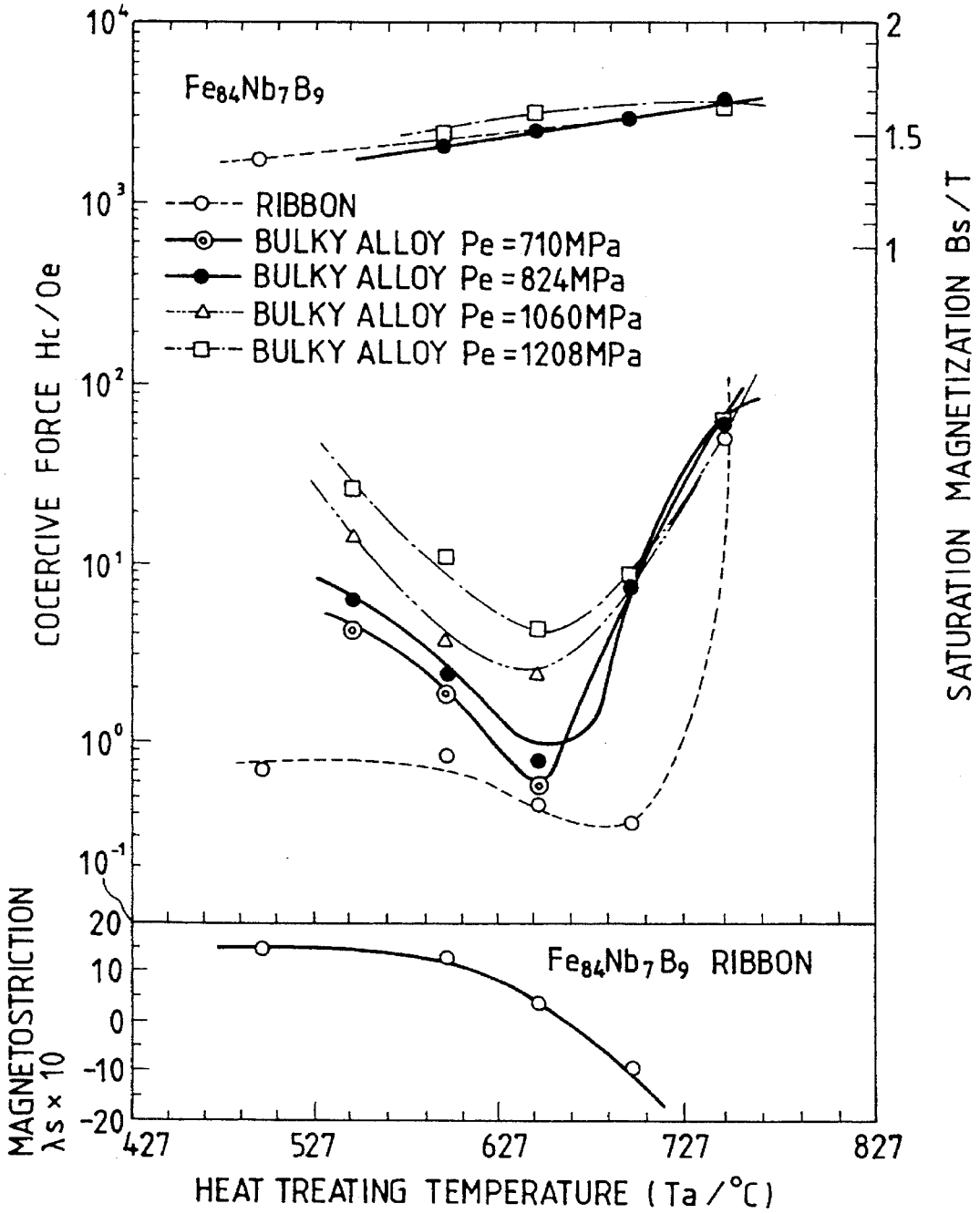
FIG. 14 shows the magnetic characteristics of alloy samples extruded under various pressures.

FIG. 14 shows the saturation magnetization (Bs), the coercive force (Hc) and the magnetostriction of the extruded sample having the aforementioned composition which was extruded under various pressures. Changes in the extruding pressure do not greatly change the saturation magnetization of the sample. However, the coercive force at a heat treating temperature of 650° C. was relatively low in a sample which was extruded under a low pressure. In other words, formation under a low pressure assures a material having a high saturation magnetization and exhibiting excellent magnetic characteristics.

Figure 15:
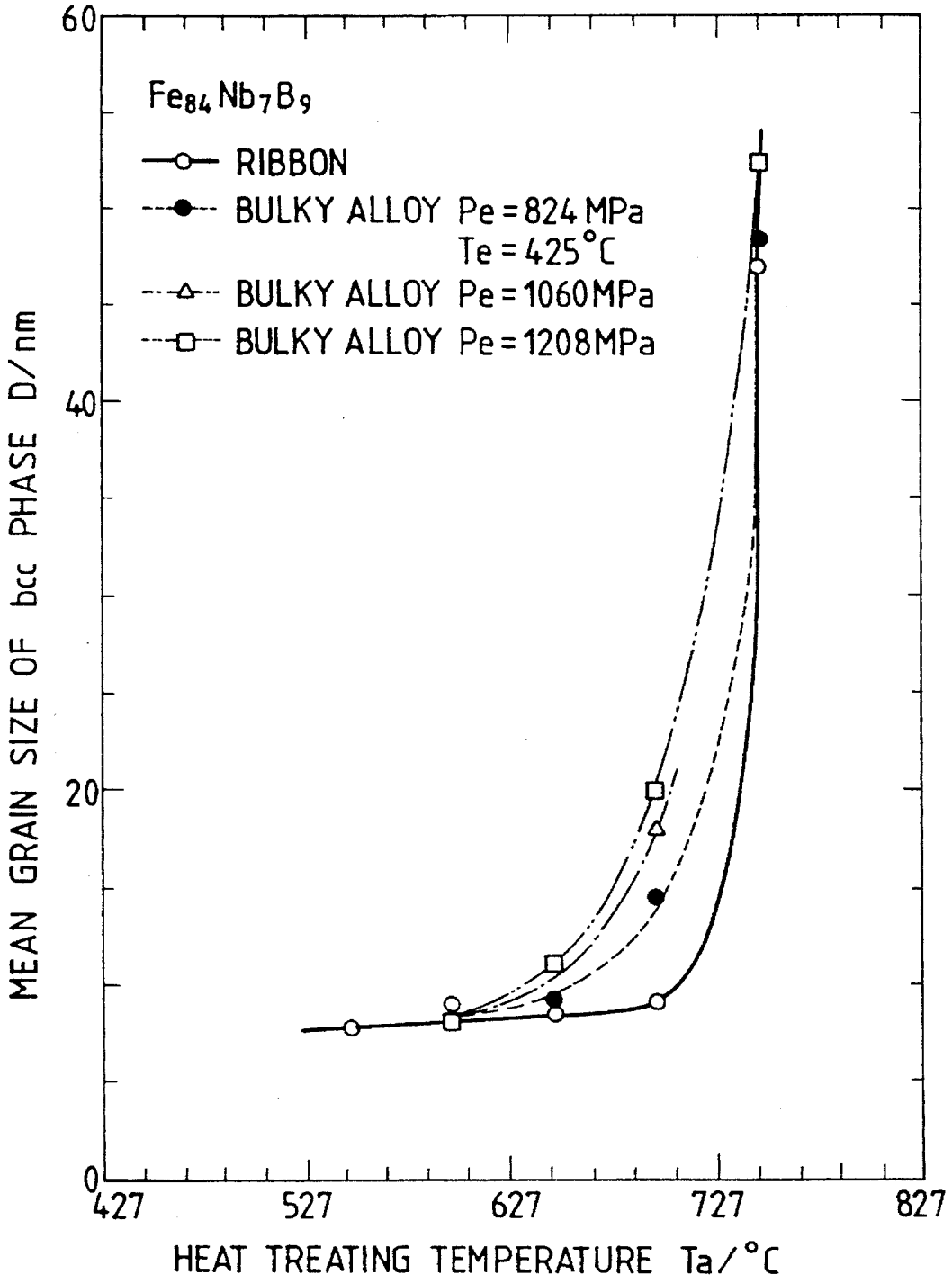
FIG. 15 shows the heat treating temperature and mean grain size of the samples manufactured under the same conditions as those shown in FIG. 14.

FIG. 15 shows the relation between the mean grain size and the heat treating temperature of the samples manufactured under the aforementioned conditions. Whereas FIG. 10 shows the heat treating temperature dependency of the mean grain size, FIG. 15 shows how changes in the extruding conditions change the growth of the grain of the sample. It is clear from FIG. 15 that the grain grows faster in a sample extruded under a higher pressure than in a sample extruded under a low pressure.

It is estimated that the sample extruded under a low pressure exhibits excellent magnetic characteristics, because in a sample extruded under a high-pressure, part of the alloy is crystallized due to the heat generated during extrusion and such a crystallized portion causes non-uniform growth of the grain during heat treatment.

Figure 16:
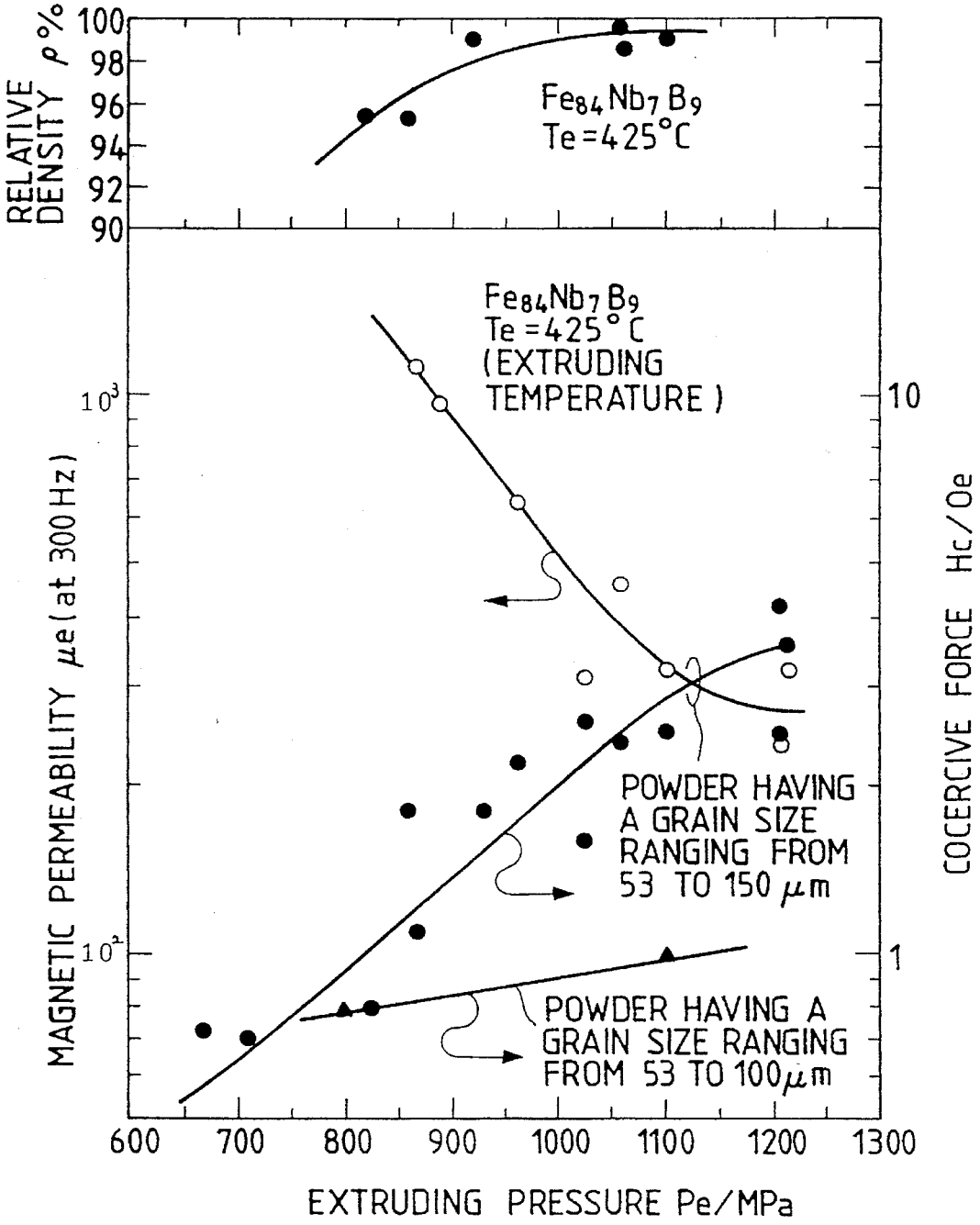
FIG. 16 shows the extruding pressure dependency of the permeability, the coercive force and the relative density.

FIG. 16 shows the extruding pressure dependency of the coercive force and magnetic permeability in a $Fe_{84}Nb_7B_9$ sample which was heat treated it 650° C. after extruded at an extrusion temperature of 425° C. It is clear from FIG. 16 that the lower the extruding pressure, the lower coercive force. Regarding the magnetic permeability, the lower the extruding pressure, the higher the magnetic permeability. This means that a material formed under a low extruding pressure exhibits excellent soft magnetic characteristics. When the material is extruded under an extruding pressure of 900 MPa or below, it has Hc of 1 oersted (Oe) or below. The alloy manufactured from the powder having a grain size of 100 μm exhibited better magnetic characteristics than the alloy manufactured from the powder having a grain size from 53 to 150 μm, because it is estimated that the shearing stress applied to smaller grain size during extrusion is smaller than that applied to larger grain sizes and non-uniform crystallization thus does not readily occur. Thus, the use of powder having a grain size from 53 to 100 μm is desirable.

It is also clear from FIG. 16 that the lower the extruding pressure, the lower the relative density. When the extruding pressure is 950 MPa or above, the sample has a relative density of 95% or above.

This is because a reduction in the extruding pressure deteriorates a formed state of the sample. When the extruding pressure becomes low, the formed material becomes so brittle that it may not withstand machining conducted thereon after formation. In order to manufacture a formed material that can withstand machining, the material must be extruded under a pressure of 500 MPa or above, because the sample having the same composition as the above-described sample could not be formed under 496 MPa, The desirable extruding pressure is 1300 MPa or below. Although an increase in the extruding pressure provides a sample in a good formed state, it may damage the extruding device, such as the container or the pressing bar thereof. In view of the material (SKD) of the pressing bar, 1300 MPa is the limit.

Figure 17:
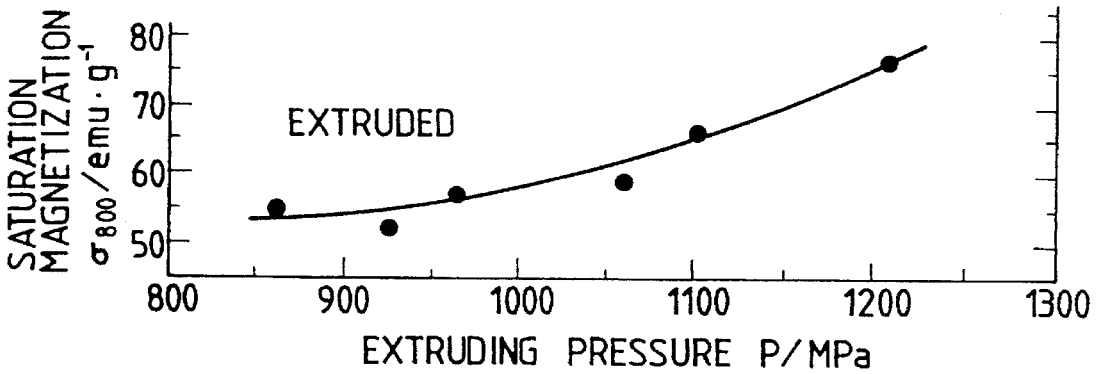
FIG. 17 shows the relation between the extruding pressure and the saturation magnetization.

FIG. 17 shows the relation between the extruding pressure and the saturation magnetization per unit mass in a sample having a composition shown in FIG. 16 and extruded at a temperature of 425° C. It is clear from FIG. 17 that the higher the extruding pressure, the larger the saturation magnetization. An increase in the saturation magnetization of the just extruded sample means that the bcc phase is partially present in the formed material. The higher the extruding pressure, the larger the rate of the volume of bcc.

Figure 18:
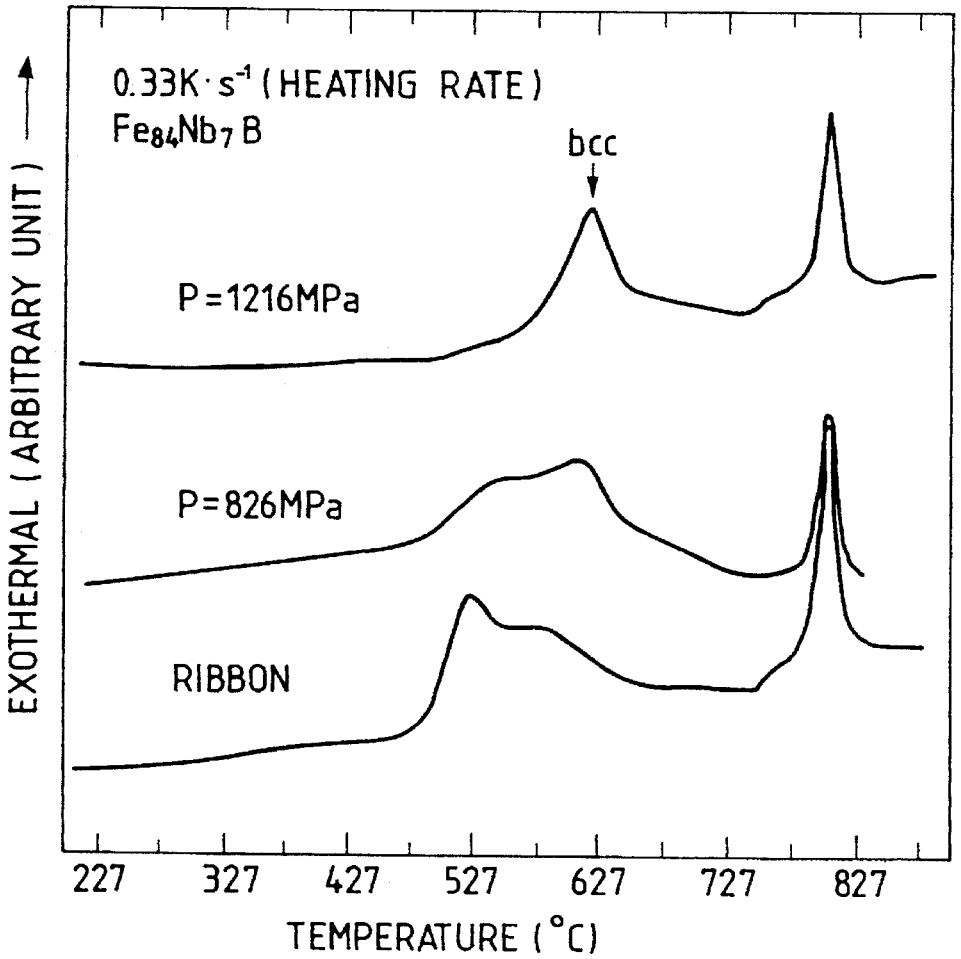
FIG. 18 shows DSC curves of an amorphous alloy having a composition expressed by $Fe_{84}Nb_7B_9$.

FIG. 18 Shows DSC curves of the sample having a composition expressed by $Fe_{84}Nb_7B_9$ extruded under various extruding pressures. In FIG. 18, respective DSC curves are shown in such a manner that they are separated from each other in the direction of the ordinate axis for the convenience of comparison. This does not mean that the sample extruded under a higher pressure has a higher exotherm but the three curves a actually start from the position representing the same exotherm.

In the sample extruded under a high pressure shown in FIG. 18, the bcc reacting exotherm (corresponding to the area of a crest of a heating peak) is smaller than that of the sample extruded under a low pressure, and the bcc reaction is shifted toward a high-temperature side. This implies that the bcc phase is partially present in the amorphous phase of the extruded amorphous alloy and that the crystallization temperature of the remaining amorphous phase has increased. This tendency increases as the extruding pressure of the sample increases. This means that the higher the extruding pressure, the larger the amount of precipitated bcc phase, and coincides with the explanation made in connection with FIG. 17. It is estimated from FIG. 18 that the heating peak near 627° C. represents the bcc reacting exotherm, and that the exothermic heat indicated by the sharp peak near 827° C. is caused by the precipitation of a compound of Fe and B.

The heated state of the extruded sample will be estimated from both the heat treating temperature dependency of the mean grain size of the bcc phase, which has been described in connection with FIG. 15, and the results shown in FIG. 18, As has been described in connection with FIG. 15, the bcc phase grains have already grown partially in the sample extruded under a high pressure. This suggests that part of the bcc phase which is present in a formed state grows at an earlier stage than the bcc phase which grows from the remaining amorphous phase, thus generating non-uniform fine grains. The reason why the bulky alloy extruded under a high pressure does not exhibit excellent soft magnetic characteristics, as shown in FIG. 16, is that the bcc phase which is already present partially in a formed state grows into a relatively large grain size, and this bcc phase is mixed with the bcc phase with fine grain size generated from the amorphous phase thereafter, making the fine grains non-uniform.

Figure 19:
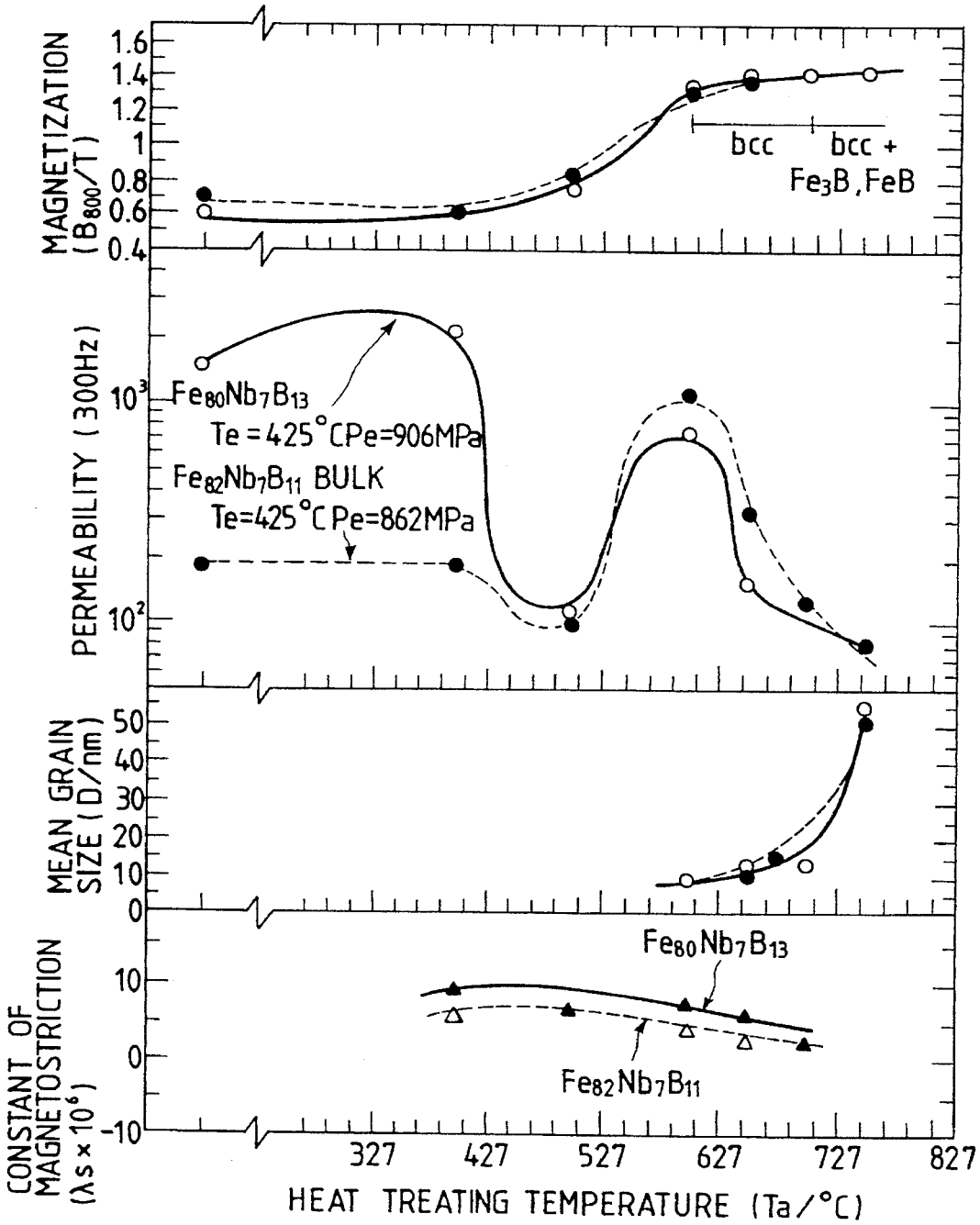
FIG. 19 shows the relation between the heat treating temperature, the magnetization, the magnetic permeability, the grain size and the constant of magnetostriction of amorphous alloys having both a composition expressed by $Fe_{80}Nb_7B_{13}$ and a composition expressed by $Fe_{82}Zr_7B_{11}$.

FIG. 19 shows the magnetization ($B_{800}$), the permeability μe (300 Hz), the mean grain size of the bcc phase of a bulky sample having a composition expressed by $Fe_{82}Nb_7B_{11}$ and those of a bulky sample having a composition expressed by $Fe_{80}Nb_7B_{13}$. FIG. 19 also shows the magnetostriction (λs) of the ribbon samples having the same compositions as the above-described ones. After heat treatment, the magnetostriction of these compositions was not zero. This is different from the case of the $Fe_{84}Nb_7B_9$ alloy. Further, these compositions indicated the high permeability of about 1,000.

Figure 20:
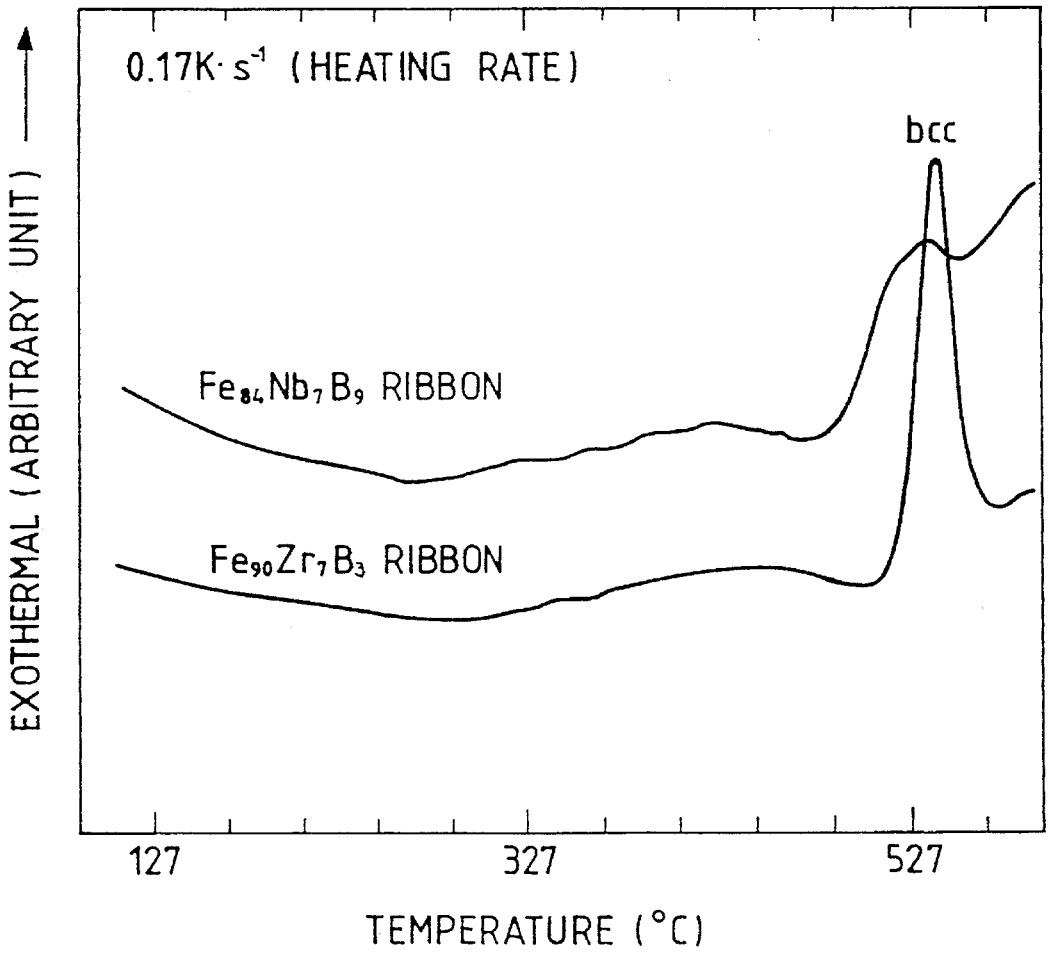
FIG. 20 shows DSC curves of amorphous alloys having both a composition expressed by $Fe_{84}Nb_7B_9$ and a composition expressed by $Fe_{90}Zr_9B_3$.

FIG. 20 shows a DSC curve of a bulky sample having a composition expressed by $Fe_{84}Nb_7B_9$ and that of a bulky sample having a composition expressed by $Fe_{90}Zr_7B_3$. In FIG. 20, the respective curves are shown for the convenience of comparison in such a manner that they are separated from each other in the direction of the ordinate axis, as in the case of FIG. 18.

It can be seen from FIG. 20 that the $Fe_{90}Zr_7B_3$ sample has a higher crystallization temperature than the $Fe_{84}Nb_7B_9$ sample. This means that when extrusion is conducted under the same conditions, the $Fe_{90}Zr_7B_3$ alloy can be formed in a state closer to the amorphous phase than the $Fe_{84}Nb_7B_9$ alloy. That is, in the $Fe_{90}Zr_7B_3$ alloy, the precipitation of the bcc phase during extrusion, which prohibits generation of the fine grains during heat treatment can be restricted.

Figure 21:
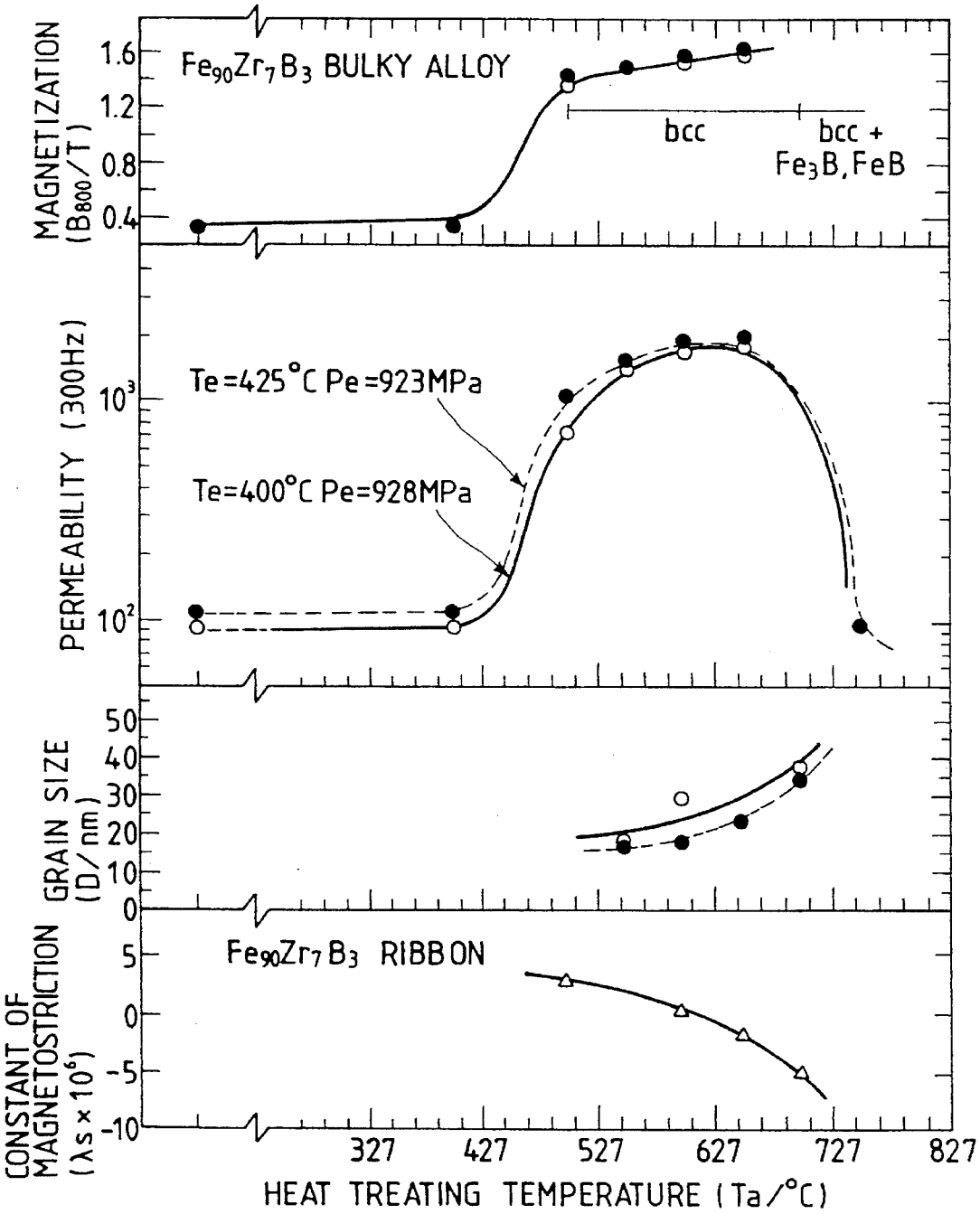
FIG. 21 shows the relation between the heat treating temperature, the magnetization, the magnetic permeability, the grain size and the constant of magnetostriction of an amorphous alloy having both a composition expressed by $Fe_{90}Zr_7B_3$.
Figure 22:
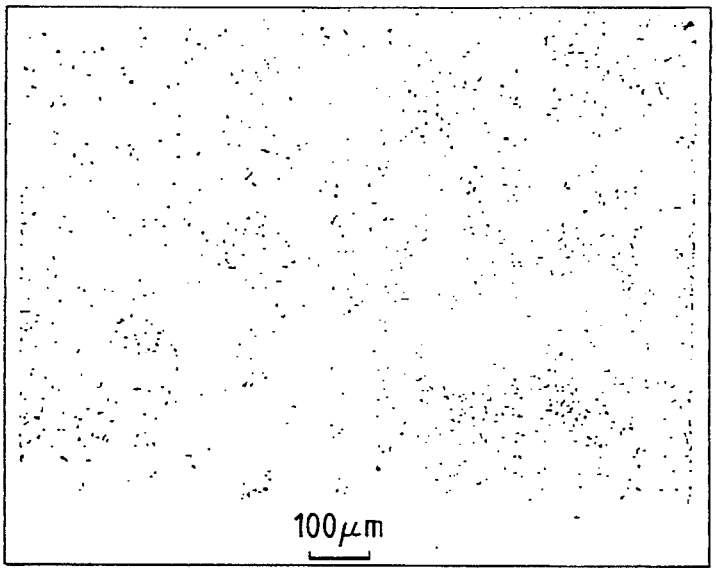
FIG. 22 is a schematic view of a microscopic photograph of an amorphous alloy having a composition expressed by $Fe_{90}Zr_7B_3$.

FIG. 21 shows the magnetization ($B_{800}$), the permeability μe (300 Hz), and the mean grain size of the bcc phase of the bulky sample having a composition expressed by $Fe_{90}Zr_7B_3$, as well as the magnetostriction (λs) of the ribbon sample having the same composition as the bulky sample. After heat treatment, the magnetostriction of such a composition becomes substantially zero. Further, such a composition has a high permeability of 1800 even when it is extruded under a relatively high extruding pressure of 900 MPa. FIG. 22 shows a optical microscopic photograph of an extruded bulky alloy sample. As can be seen from FIG. 22, the sample has an excellent formed state. The relative density of the sample was 99% or above.

Figure 23:
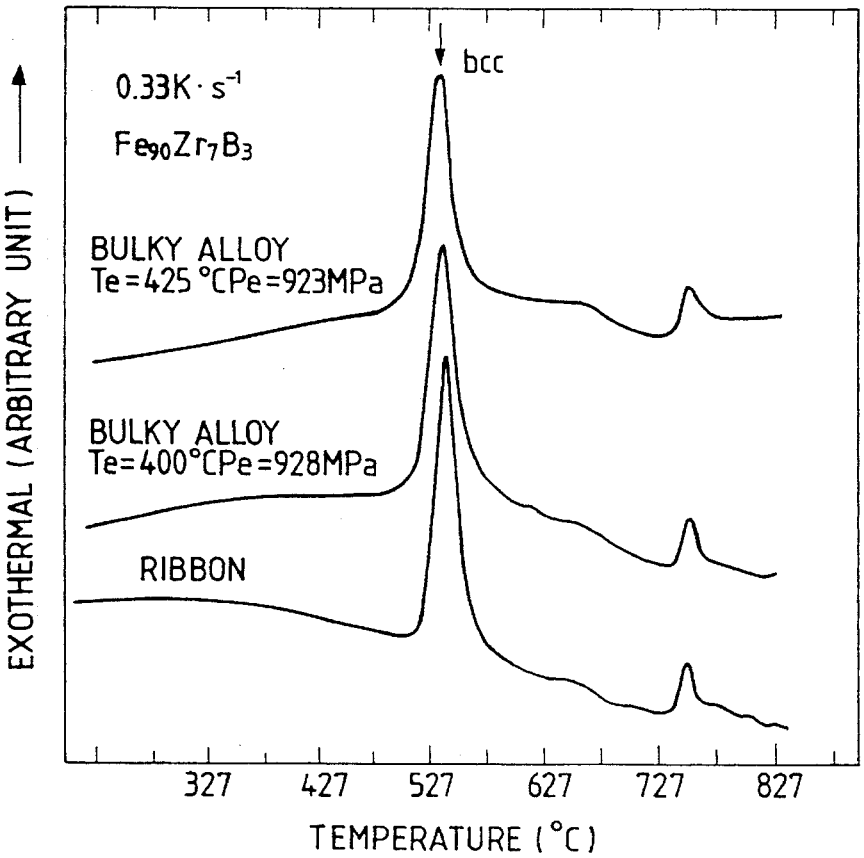
FIG. 23 shows DSC curves of an amorphous bulky alloy having both a composition expressed by $Fe_{90}Zr_7B_3$.

FIG. 23 shows a DSC curve of the bulky sample having a composition expressed by $Fe_{90}Zr_7B_3$. The crystallization reacting exotherm of the bcc phase of the bulky alloy is substantially the same as that of the ribbon. This means that the bulky alloy having the above composition can be extruded in a state closer to the amorphous phase than with the bulky alloy having a composition expressed by $Fe_{84}Nb_7B_9$. Table 4 lists the characteristics of various samples.

TABLE 4

| Composition | Extruding conditions Temperature (°C.) | Pressure (MPa) | Speed (mm/s) | Annealing temperature (°C.) | Bs (T) | μe (300 Hz) | Hc (Oe) |
|---|---|---|---|---|---|---|---|
| Fe90Zr7B3 | 425 | 923 | 5 | 650 | 1.64 | 1866 | 0.36 |
| Fe90Zr7B3 | 400 | 938 | 5 | 650 | 1.63 | 1736 | 0.48 |
| Fe90Zr7B3 | 380 | 945 | 5 | 650 | 1.64 | 1566 | 0.46 |
| Fe90Zr7B3 | 425 | 960 | 2.5 | 650 | 1.65 | 1800 | 0.40 |
| Fe91Zr7B2 | 425 | 921 | 5 | 650 | 1.70 | 1900 | 0.36 |
| Fe91Zr7B2 | 400 | 932 | 5 | 650 | 1.69 | 1750 | 0.48 |
| Fe89Zr7B4 | 425 | 955 | 5 | 650 | 1.60 | 1600 | 0.50 |
| Fe88Zr7B5 | 425 | 970 | 2.5 | 650 | 1.49 | 1300 | 0.78 |
| Fe90Zr7B3 | 425 | 905 | 5 | 650 | 1.66 | 1760 | 0.35 |
| Fe89Zr7B3 | 425 | 844 | 5 | 650 | 1.62 | 1400 | 0.40 |
| Fe89Zr7B3 | 400 | 900 | 3 | 650 | 1.61 | 1440 | 0.48 |
| Fe88Zr7B5 | 425 | 920 | 5 | 650 | 1.55 | 1500 | 0.50 |

It is clear from Table 4 that an alloy can be extruded in a state closer to the amorphous phase when the heat treating temperature is increased and the magnetostriction is reduced. In order to obtain the amorphous phase immediately after quenching in an alloy having a composition expressed by $Fe_{100-d-e}M_dB_e$, where M is Zr and/or Hf, d must be equal to or greater than 6 atomic percent, and e must be equal to or greater than 2 atomic percent. In order to reduce the magnetostriction of the bcc single phase to a value close to zero after heat treatment, d must be equal to or less than 9 atomic percent, and e must be equal to or less than 9 atomic percent. Hence, in this embodiment of the present invention, $6 \leqq d \leqq 9$ atomic percent, and $2 \leqq e \leqq 9$ atomic percent.

As will be understood from the foregoing description, since the bulky alloy according to the present invention has the bcc phase with fine grain sizes of 30 nm or less due to the formation of powder mainly made of Fe-M(=Ti, Zr, Hf, V, Nb, Ta, Mo or W)-B based amorphous alloy under pressure, it exhibits excellent soft magnetic characteristics and saturation magnetization. Further, when such a phase is heat treated to precipitate the fine grains, the soft magnetic characteristics of the obtained alloy can be greatly improved, and the saturation magnetization thereof can be sufficiently increased. Thus, the obtained alloy is suitable for use as the magnetic core of a magnetic head used with recording media having a higher recording density than that of a conventional one, as the magnetic core of a pulse motor, or as the core of a transformer. It can also readily cope with various shapes.

The use of an alloy having a composition expressed by $Fe_{100-d-e}M_dB_e$, where M is Zr and/or Hf, $6 \leqq d \leqq 9$ atomic percent, and $2 \leqq e \leqq 9$ atomic percent as the extruded alloy is desirable. Such an alloy can be extruded in a state close to the amorphous phase. Thus, the fine grains can be readily obtained after heat treatment. In that case, the magnetostriction of the alloy can be reduced to a value close to zero.

Further, in the method according to the present invention, since the powder and granule mainly made of a Fe-M-B based amorphous alloy are warm extruded to form a primary formed article, bulking can be done satisfactorily. When such a primarily formed article is heat treated, the bcc phase with fine grain sizes can be precipitated. Thus, the soft magnetic characteristics can be improved while the saturation magnetization can be increased after heat treatment.

Further, when extrusion is conducted at a temperature near the softening temperature of the Fe-M-B based amorphous alloy utilizing the softening temperature thereof, smooth extrusion can be performed.

Sufficiently effective and reliable extrusion can be performed when the extruding pressure is between 900 and 1300 MPa and the extruding temperature is between 300° and 600° C. Further, when the heat treatment is conducted at a temperature ranging from 500° to 700° C. after extrusion, an increase in the bcc phase grain size can be prevented, and fine grains can thus be obtained.

In the manufacturing method according to the present invention, when the amorphous alloy ribbon obtained from molten metal of Fe-M-B based alloy is milled, since fine powder having a grain size of 53 μm or below is removed, the crystalline phase which has been crystallized from the amorphous phase during milling of the impurities which have entered during milling can be removed from the powder. Thus, only the amorphous powder can be extruded, and the obtained bulky alloy exhibits excellent soft magnetic characteristics and high saturation magnetization.

In addition, since the powder having grain size ranging from 53 to 100 μm is selectively used, the shearing force applied to the powder during extrusion can be reduced, making generation of non-uniform crystalline phase difficult. Thus, the obtained bulky alloy exhibits excellent soft magnetic characteristics and high saturation magnetization.

What is claimed is:

1. A method of manufacturing an extrusion from amorphous magnetic alloy powder, the amorphous magnetic alloy powder having a softening temperature and a crystallization temperature, the softening temperature being lower than the crystallization temperature, the method comprising the steps of:

heating the amorphous magnetic alloy powder to a first temperature; and extruding the heated amorphous magnetic alloy powder at a pressure such that frictional Meat generated during extrusion causes the amorphous magnetic alloy powder to increase from the first temperature to a second temperature, the second temperature being a maximum temperature achieved by the amorphous magnetic alloy powder during extrusion;

wherein the second temperature is between the softening temperature and the crystallization temperature such that the extruded magnetic alloy does not include a crystalline phase.

2. The method according to claim 1, wherein the first temperature is between 300° and 600° C.

3. The method according to claim 2, wherein the pressure is between 500 and 1300 MPa.

4. The method according to claim 3, wherein the pressure is between 900 and 1200 MPa.

5. The method according to claim 1, wherein the amorphous magnetic alloy powder is formed from an alloy consisting essentially of Fe, B and M, where M is at least one element selected from a group consisting of Ti, Zr, Hf, V, Nb, Ta, Mo and W, and the method further comprising:

heat treating the extruded amorphous magnetic alloy powder at a third temperature to form a fine crystalline grains having sizes of 30 nm or less, the third temperature being greater than the crystallization temperature.

6. The method according to claim 5, wherein the third temperature is between 500° and 700° C.

7. A method of manufacturing an extrusion from an amorphous magnetic alloy, the amorphous magnetic alloy having a softening temperature and a crystallization temperature, the softening temperature being less than the crystallization temperature, the method comprising the steps of:

melting the amorphous magnetic alloy;

quenching the molten amorphous magnetic alloy to form a ribbon;

grinding the amorphous magnetic alloy ribbon to form powder;

heating the amorphous magnetic alloy powder to a first temperature; and extruding the heated amorphous magnetic alloy powder at a pressure such that frictional heat generated during extrusion causes the amorphous magnetic alloy powder to increase from the first temperature to a second temperature, the second temperature being a maximum temperature achieved by the amorphous magnetic alloy powder during extrusion;

wherein the second temperature is between the softening temperature and the crystallization temperature such that the extruded magnetic alloy does not include a crystalline phase.

8. The method according to claim 7, wherein the first temperature is between 300° and 600° C.

9. The method according to claim 8, wherein the pressure is between 500 and 1300 MPa.

10. The method according to claim 9, wherein the pressure is between 900 and 1200 MPa.

11. The method according to claim 7, wherein the amorphous magnetic alloy consists essentially of Fe, B and M, where M is at least one element selected from a group consisting of Ti, Zr, Hf, V, Nb, Ta, Mo and W, and the method further comprises:

heat treating the extruded amorphous magnetic alloy powder at a third temperature to form an amorphous alloy phase including a bcc phase with fine grain sizes of 30 nm or below, the third temperature being greater than the crystallization temperature.

12. The method according to claim 7, further comprising the step of separating the ground amorphous magnetic alloy ribbon into a first group of particles, each particle of the first group having a diameter ranging from 53 to 100 μm, and a second group of particles, each particle of the second group either having a diameter less than 53 μ m or a diameter greater than 100 μm;

wherein the amorphous magnetic alloy powder consists essentially of particles from the first group.

13. A method of manufacturing an extrusion from an amorphous magnetic alloy, the amorphous magnetic alloy having a softening temperature and a crystallization temperature, the softening temperature being less than the crystallization temperature, the method comprising the steps of:

atomizing the amorphous magnetic alloy to form powder;

heating the amorphous magnetic alloy powder to a first temperature; and extruding the heated amorphous magnetic alloy powder at a pressure such that frictional heat generated during extrusion causes the amorphous magnetic alloy powder to increase from the first temperature to a second temperature, the second temperature being a maximum temperature achieved by the amorphous magnetic alloy powder during extrusion;

wherein the second temperature is between the softening temperature and the crystallization temperature such that the extruded magnetic alloy does not include a crystalline phase.

14. The method according to claim 13, wherein the first temperature is between 300° and 600° C.

15. The method according to claim 14, wherein the pressure is between 500 and 1300 MPa.

16. The method according to claim 15, wherein the pressure is between 900 and 1200 MPa.

17. The method according to claim 13, wherein the amorphous magnetic alloy consists essentially of Fe, B and M, where M is at least one element selected from a group consisting of Ti, Zr, Hf, V, Nb Ta, Mo and W, and the method further comprises:

heat treating the extruded amorphous magnetic alloy powder at a third temperature to form an amorphous alloy phase including a bcc phase with fine grain sizes of 30 nm or below, the third temperature being greater than the crystallization temperature.

18. A method of manufacturing an extrusion from amorphous magnetic alloy powder having a crystallization temperature, the method comprising the steps of:

heating the amorphous magnetic alloy powder to a first temperature between 300° and 600° C.;

extruding the heated amorphous magnetic alloy powder at a pressure between 500 and 1300 MPa such that frictional heat generated during extrusion causes the amorphous magnetic alloy powder to increase from the first temperature to a second temperature, the second temperature being a maximum temperature achieved by the amorphous magnetic alloy powder during extrusion;

wherein the second temperature is between the softening temperature and the crystallization temperature such that the extruded magnetic alloy does not include a crystalline phase.

19. The method according to claim 18, wherein the pressure is between 900 and 1200 MPa.

20. The method of claim 18, wherein the amorphous magnetic alloy powder is formed from an alloy consisting essentially of Fe, B and M, where M is at least one element selected from a group consisting of Ti, Zr, Hf, V, Nb, Ta, Mo and W, and the method further comprising:

heat treating the extruded amorphous magnetic alloy powder at a third temperature to form an amorphous alloy phase including a bcc phase with fine grain sizes of 30 nm or below, the third temperature being greater than the crystallization temperature.

21. The method of claim 18, wherein the amorphous magnetic alloy powder comprises particles having a diameter between 53 μm and 100 μm.

22. The method of claim 18, further comprising the step of heat treating the extruded amorphous magnetic alloy powder at a third temperature between 400° and 700° C., wherein the third temperature is greater than the crystallization temperature.

* * * * *

UNITED STATES PATENT AND TRADEMARK OFFICE

CERTIFICATE OF CORRECTION

PATENT NO. : 5,509,975

DATED : April 23, 1996

INVENTOR(S) : Akinori Kojima, Katsuaki Hangai, Shoji Yoshida, Akihiro Makino, Tsuyoshi Masumoto and Akihisa Inoue It is certified that error appears in the above-identified patent and that said Letters Patent is hereby corrected as shown below:

Col. 18, line 50, delete "Meat" and insert --heat--; and

Col. 19, line 55, delete "$\mu$ m" and insert --$\mu$m--.

Signed and Sealed this

Twenty-seventh Day of August, 1996

Bruce Lehman

*Attest:*

BRUCE LEHMAN

*Attesting Officer*

*Commissioner of Patents and Trademarks*